US006063535A

United States Patent [19]

Tsutsui et al.

[11] Patent Number: 6,063,535

[45] Date of Patent: May 16, 2000

[54] MONO-COMPONENT DEVELOPING METHOD

[75] Inventors: Chikara Tsutsui, Nishinomiya; Katsunori Kurose, Amagasaki; Masahiro Anno, Sakai; Minoru Nakamura, Takarazuka; Hiroyuki Fukuda, Sanda, all of Japan

[73] Assignee: Minolta Co., Ltd., Osaka, Japan

[21] Appl. No.: 09/290,616

[22] Filed: Apr. 13, 1999

[30] Foreign Application Priority Data

| | | | |
|---|---|---|---|
| Apr. 14, 1998 | [JP] | Japan | 10-102459 |
| Apr. 14, 1998 | [JP] | Japan | 10-103016 |
| Apr. 14, 1998 | [JP] | Japan | 10-103021 |
| Mar. 11, 1999 | [JP] | Japan | 11-064568 |

[51] Int. Cl.[7] ..... G03G 13/08; G03G 13/09

[52] U.S. Cl. ..... 430/102; 430/122; 430/106.6; 430/111; 430/903

[58] Field of Search ..... 430/102, 122

[56] References Cited

U.S. PATENT DOCUMENTS

| | | | |
|---|---|---|---|
| 4,996,126 | 2/1991 | Anno et al. | 430/106.6 |
| 5,063,133 | 11/1991 | Kubo et al. | 430/122 |
| 5,066,558 | 11/1991 | Hikake et al. | 430/109 |
| 5,206,109 | 4/1993 | Anno | 430/137 |
| 5,350,657 | 9/1994 | Anno et al. | 430/111 |
| 5,804,351 | 11/1991 | Takano et al. | 430/111 |

FOREIGN PATENT DOCUMENTS

| | | |
|---|---|---|
| 63-319037 | 12/1988 | Japan . |
| 01257857 | 10/1989 | Japan . |
| 04226476 | 8/1992 | Japan . |
| 06317928 | 11/1994 | Japan . |
| 06317933 | 11/1994 | Japan . |
| 9-258474 | 3/1997 | Japan . |

*Primary Examiner*—Roland Martin
*Attorney, Agent, or Firm*—McDermott, Will & Emery

[57] ABSTRACT

A mono-component developing method, comprising the steps of:

supplying a mono-component developing agent containing a toner onto a developer-supporting member that is aligned face to face with an image-supporting member;

regulating the developing agent on the developer-supporting member by a regulating member installed in contact with the developer-supporting member; and developing an electrostatic latent image formed on the image-supporting member by the toner, wherein the toner has a weight-average particle size ($d_{50}$) in the range of 4 to 10 $\mu$m, an average degree of roundness of not less than 0.950 and a standard deviation of degree of roundness of not more than 0.040, and more preferably the toner has a specific value of a surface shape characteristic $D/d_{50}$, and a specific ratio $d_{50}/Ra$ of the toner weight-average particle size ($d_{50}$) to the surface roughness (Ra) of the developer-supporting member.

35 Claims, 7 Drawing Sheets

MONO-COMPONENT DEVELOPING METHOD

This application is based on applications No. Hei 10-02459, Hei 10-103016, Hei 10-103021 and Hei 11-064568 filed in Japan, the contents of which are hereby incorporated by reference.

BACKGROUND OF THE INVENTION

1. Field of the Invention

The present invention relates to a developing method for developing electrostatic latent images in electrophotography and electrostatic printing, and more specifically to a mono-component developing method using a mono-component developing agent.

2. Description of the Related Art

In the mono-component developing method, since toner passes between the developing sleeve and the developer-regulating blade to be charged electrically, a great stress is applied to the toner. This stress causes embedment of post-treating agents and toner cracking and the subsequent generation of smaller-size particles, resulting in adhesion of the toner component to the developer-regulating blade. The resulting problems are insufficient charging due to degradation in the toner-thin-layer forming capability, filming due to fused toner component onto the sleeve and fog on the photosensitive member, thereby failing to provide a good developing process.

In order to solve these problems, techniques for conglobating the shape of toner have been developed in recent years. The conglobation of toner minimizes the toner cracking due to the stress, reduces the occurrence of smaller-size particles, and reduces sleeve filming, etc.

More specifically, there have been proposed a method for preparing spherical toner by using a suspension polymerization method and an emulsion polymerization method in a wet system (Japanese Patent Application Laid-Open No. Hei 1-257857(1989) and techniques for conglobating toner by thermally treating pulverized toner (Japanese Patent Publication No. Hei 4-27897(1992) (Japanese Patent Application Laid-Open No. Hei 6-317928(1994).

However, the conglobation of toner shape reduces toner powder pressure at the contact section with the developer-regulating blade, resulting in a new problem of insufficient toner transferability due to insufficient toner passage between the developer-transferring and supporting member and the developer-regulating blade.

An attempt has been made to provide a certain degree of irregularity to the developer-transferring and supporting member so as to improve the transferring properties. However, the conventional conglobated toner fails to provide sufficient durability and charging stability. In particular, in the case of high transferring speeds of the developer sleeve for high speed systems, the conventional conglobated toner causes filming due to fused toner onto the surface of the sleeve and fog on the photosensitive member, resulting in degradation in durability and charging stability.

SUMMARY OF THE INVENTION

The present invention has been devised to solve the above-mentioned problems. The present invention is to provide a mono-component developing method which achieves superior charging stability, and does not cause sleeve filming and fog on the photosensitive member even after repeated copying processes in high-speed range as well as in low-speed range.

DETAILED DESCRIPTION OF THE INVENTION

Figure 1:
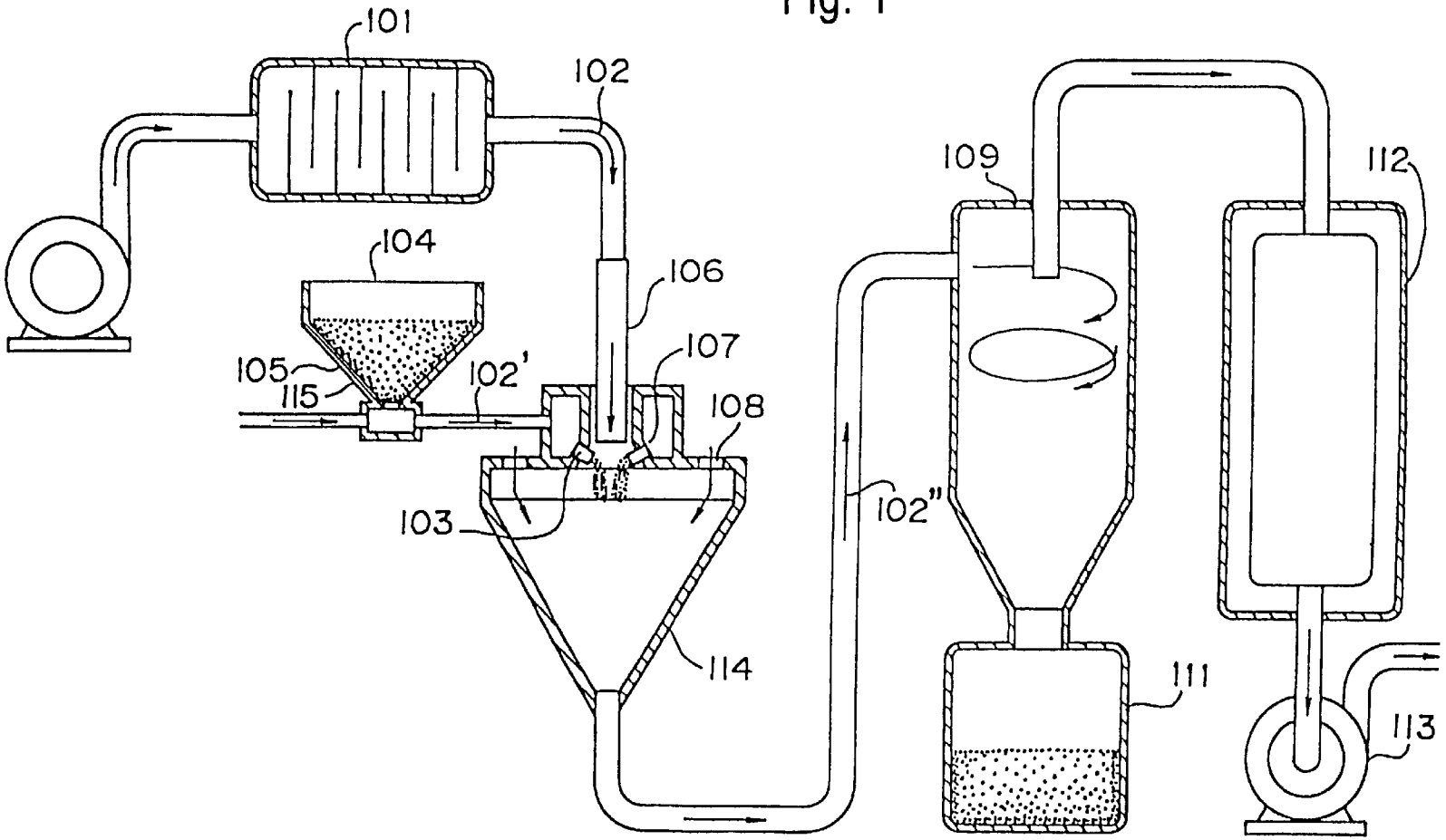
FIG. 1 is a schematic view showing structure of device for carrying out instantaneous heating treatment.

The present invention relates to a mono-component developing method, comprising the steps of:

supplying a mono-component developing agent containing a toner onto a developer-supporting member that is aligned face to face with an image-supporting member;

regulating the developing agent on the developer-supporting member by a regulating member installed in contact with the developer-supporting member; and developing an electrostatic latent image formed on the image-supporting member by the toner. One of the major characteristics of the mono-component developing method of the present invention lies in its toner. The toner is designed so that the weight-average particle size ($d_{50}$) is within the range of 4 to 10 $\mu$m, preferably 5 to 9 $\mu$m, the average degree of roundness is at not less than 0.950, and the standard deviation of the degree of roundness SD is at not more than 0.040. In the case of non-magnetic toners, those having a surface shape characteristic $D/d_{50}$ of not less than 0.40 are used, and in the case of magnetic toners, those having a surface shape characteristic $D/d_{50}$, of not less than 0.20 are used. In the case of non-magnetic toners, the average degree of roundness is set at not less than 0.960, preferably not less than 0.965, and the standard deviation of the degree of roundness SD is set at not more than 0.040, preferably not more than 0.035. In the case of magnetic toners, the average degree of roundness is set at not less than 0.950, preferably riot less than 0.955, and the standard deviation of the degree of roundness SD is set at not more than 0.040, preferably not more than 0.035.

In addition, the mono-component developing method is characterized in that a ratio $d_{50}/Ra$ of the toner weight-average particle size $d_{50}$ to the surface roughness (Ra) of the developer-transferring and supporting member satisfies the relationship of $0.6 \leqq d_{50}/Ra \leqq 3.0$, preferably $0.7 \leqq d_{50}/Ra \leqq 2.5$. With this condition, it becomes possible to provide a mono-component developing method which ensures a sufficient toner transferring properties and superior charging stability, reduces the occurrence of small-particle-size component, and which is free from sleeve filming and fog on the photosensitive member, even after repeated copying processes in high-speed range as well as in low-speed range.

In the present invention, since the toner has a high degree of roundness with its less dispersion and is free from cracking, it is possible to obtain a highly stable operation even during endurance operations in high-speed range.

Since spherical toners have a disadvantage that it is difficult to obtain a sufficient powder pressure in the vicinity of the developer-regulating blade, the present invention improves the passage of spherical toner by allowing the following relationship to be satisfied by the surface roughness Ra of the peripheral surface of the developer-transferring and supporting member and the toner weight-average particle size $d_{50}$: $0.6 \leqq d_{50}/Ra \leqq 3.0$.

When $d_{50}/Ra$ is not more than 0.6, insufficient charging occurs due to excessive toner feeding. When it is not less than 3.0, feeding of toner to the developer-transferring and supporting member becomes insufficient, causing insufficient toner transferability, and the subsequent degradation in the solid-image forming-properties.

In the present specification, the average degree of roundness, the standard deviation of the degree of roundness SD, the toner surface shape characteristic $D/d_{50}$, the weight-average particle size and the surface roughness of the developer-transferring and supporting member are respectively defined as follows.

The average degree of roundness is the average value of values calculated by the following equation:

$$\text{Average degree of roundness} = \frac{\text{Peripheral length of circle equal to projection area of a particle}}{\text{Peripheral length of particle projection image}}$$

Since the average degree of roundness is obtained by "Peripheral length of a circle equal to projection area of a particle" and "Peripheral length of a particle projection image", the resulting value provides an index that correctly reflects the irregular conditions of the surfaces of particles. The closer the value to 1, the closer the shape to true sphericity. Since the average degree of roundness is a value obtained as an average value with respect to 3,000 particles, the reliability of the degree of roundness of the present invention is very high. In the present invention, with respect to the average degree of roundness, "Peripheral length of a circle equal to projection area of a particle" and "Peripheral length of a particle projection image" are represented by values obtained through measurements carried out by a flow-type particle image analyzer (EPIA-1000 or EPIA-2000; made by Toa Iyoudenshi K.K.) in an aqueous dispersion system. Additionally, in the present description, the average degree of roundness is not necessarily measured by the above-mentioned apparatus, and any apparatus may be used as long as it is capable of carrying out the measurements based upon the above-mentioned equation in principle.

The standard deviation of the degree of roundness indicates a standard deviation in the distribution of the degree of roundness. This value is obtained together with the average degree of roundness at the same time by the above-mentioned flow-type particle image analyzer. The smaller the value, the more uniform the toner particle shapes.

The surface shape characteristic means a characteristic represented by the following expression:

$D/d_{50}$, in which $D=6/(\rho \cdot S)$ (in the expression, D represents a converted particle size ($\mu$m) from the BET specific surface area obtained when it is supposed that the toner shape is spherical); $d_{50}$ is a weight-average particle size ($\mu$m) corresponding to 50% of the relative weight distribution classified by particle sizes; $\rho$ is a true density of toner ($g/cm^3$) ; and S is a BET specific surface area ($m^2/g$). This $D/d_{50}$ is an index indicating whether or not pores exist on the surface or the inside of the toner particle.

With respect to the BET specific surface area, values measured by a Flow Sorb 2,300 (made by Simazu Seisakusho K.K.) are used. However, the measuring device is not limited by this, and any device may be used as long as the measurements are carried out in the same measuring principle and method.

The weight-average particle size used in the present invention is a value measured by Coulter Multisizer (made by Coulter Counter K.K.). However, the measuring device is not limited by this, and any device may be used as long as the measurements are carried out in the same measuring principle and method.

With respect to the true density $\rho$, values measured by "an air-comparative specific gravity meter" (made by Beckman K.K.) are used. However, the measuring device is not limited by this, and any device may be used as long as the measurements are carried out in the same measuring principle and method.

First, an explanation will be given of a toner used in the mono-component developing method of the present invention.

The toner of the present invention is constituted of at least a binder resin and a colorant.

With respect to the binder resin, thermoplastic resins, used for toner binder resins, are used. In the present invention, those resins having a glass transition point of 50 to 75° C., a softening point of 80 to 160° C., a number-average molecular weight of 1,000 to 30,000 and a ratio of weight-average molecular weight/number-average molecular weight of 2 to 100, are preferably used.

In particular, in the case of preparation for full-color toner (including black toner), it is preferable to use resins having a glass transition point of 50 to 75° C., a softening point of 80 to 120° C., a number-average molecular weight of 2,000 to 30,000 and a ratio of weight-average molecular weight/number-average molecular weight of 2 to 20.

In the case of preparation for oil-less fixing toner or magnetic toner, a binder resin containing a first resin having a softening point of 80 to 125° C. and a glass transition point of 50 to 75° C. and a second resin having a softening point of 125 to 160° C. and a glass transition point of 50 to 75° C. is preferably used.

With respect to the toner binder resin component, a polyester resin, which has an acid value of 2 to 50 KOHmg/g, and more preferably, 3 to 30 KOHmg/g in addition to the above-mentioned characteristics, is used more preferably. By using the polyester resin having such an acid value, it is possible to improve the dispersing properties of various pigments including carbon black and charge-control agents, and also to provide a toner having a sufficient quantity of charge. The acid value less than 5 KOHmg/g reduces the above-mentioned effects. The acid value exceeding 50 KOHmg/g fails to stably maintain the quantity of toner charge against environmental fluctuations, in particular, fluctuations in humidity.

With respect to the polyester resin, polyester resins, obtained by polycondensating a polyhydric alcohol component and a polycarboxylic acid component, may be used.

Among polyhydric alcohol components, examples of dihydric alcohol components include: bisphenol A alkylene oxide additives, such as polyoxypropylene(2,2)-2,2-bis(4-hydroxyphenyl)propane, polyoxypropylene(3,3)-2,2-bis(4-hydroxyphenyl)propane, polyoxypropylene(6)-2,2-bis(4-hydroxyphenyl)propane and polyoxyethylene(2,0)-2,2-bis(4-hydroxyphenyl)propane, ethyleneglycol, diethyleneglycol, triethyleneglycol, 1,2-propyleneglycol, 1,3-propyleneglycol, 1,4-butanediol, neopentylglycol, 1,4-butenediol, 1,5-pentanediol, 1,6-hexanediol, 1,4-cyclohexanedimethanol, dipropyleneglycol, polyethyleneglycol, polytetramethyleneglycol, bisphenol A, hydrogenized bisphenol A, etc.

Examples of trihydric or more alcohol components include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Moreover, among polycarboxylic acid components, examples of dicarboxylic acid components include maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, isododecenyl succinic acid, n-dodecyl succinic acid, n-dodecyl succinic acid, isododecyl succinic acid, n-octenylsuccinic acid, isooctenyl succinic acid, n-octyl succinic acid, isooctyl succinic acid, and anhydrides of these acids or low alkyl esters.

Examples of tri- or more carboxylic acid components include alkyl ester methacrylates, such as 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butane tricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl) methane, 1,2,7,8-octanetetracarboxylic acid, pyromellitic acid, empol trimer acid, anhydrides of these acids, and low alkyl esters.

Moreover, in the present invention, with respect to the polyester resin, a material monomer for a polyester resin, a material monomer for a vinyl resin and a monomer that reacts with both of the material monomers are used, and a polycondensating reaction for obtaining a polyester resin and a radical polymerization reaction for obtaining a styrene resin are carried out in parallel in the same container. Resins thus obtained may be preferably used. The monomer that reacts with both of the resin material monomers is, in other words, a monomer that can be used in both a polycondensating reaction and a radical polymerization reaction. That is, the monomer has a carboxyl group that undergoes a polycondensating reaction and a vinyl group that undergoes a radical polymerization reaction. Examples thereof include fumaric acid, maleic acid, acrylic acid, methacrylic acid, etc.

Examples of the material monomers for polyester resins include the above-mentioned polyhydric alcohol components and polycarboxylic acid components.

Examples of the material monomers for vinyl resins include: styrene or styrene derivatives, such as styrene, o-methylstyrene, m-methylstyrene, p-methylstyrene, α-methylstyrene, p-ethylstyrene, 2,4-dimethylstyrene, p-tert-butylstyrene and p-chlorostyrene; ethylene unsaturated monoolefins, such as ethylene, propylene, butylene and isobutylene; methacrylic acid alkyl esters, such as methyl methacrylate, n-propyl methacrylate, isopropyl methacrylate, n-butyl methacrylate, isobutyl methacrylate, t-butyl methacrylate, n-pentyl methacrylate, isopentyl methacrylate, neopentyl methacrylate, 3-(methyl)butyl methacrylate, hexyl methacrylate, octyl methacrylate, nonyl methacrylate, decyl methacrylate, undecyl methacrylate and dodecyl methacrylate; acrylic acid alkyl esters, such as methyl acrylate, n-propyl acrylate, isopropyl acrylate, n-butyl acrylate, isobutyl acrylate, t-butyl acrylate, n-pentyl acrylate, isopentyl acrylate, neopentyl acrylate, 3-(methyl) butyl acrylate, hexyl acrylate, octyl acrylate, nonyl acrylate, decyl acrylate, undecyl acrylate, and dodecyl acrylate; unsaturated carboxylic acids, such as acrylic acid, methacrylic acid, itaconic acid and maleic acid; acrylonitrile, maleic acid ester, itaconic acid ester, vinyl chloride, vinyl acetate, vinyl benzoate, vinylmethyl ethyl ketone, vinyl hexyl ketone, vinyl methyl ether, vinyl ethyl ether, and vinyl isobutyl ether. Examples of polymerization initiators used upon polymerizing the material monomers for vinyl resins include azo or diazo polymerization initiators such as 2,2'-azobis(2,4-dimethylvaleronitrile, 2,2'-azobisisobutyronitrile, 1,1'-azobis(cyclohexane-1-carbonitrile) and 2,2'-azobis-4-methoxy- 2,4-dimethylvaleronitrile and peroxide polymerization initiators such as benzoyl peroxide, methylethylketone peroxide, isopropylperoxycarbonate and lauroyl peroxide.

Moreover, for a binder resin component, vinyl resins constituted of the above-mentioned material monomers may be used. Among vinyl resins, styrene-acrylic resins, which are obtained by copolymerizing styrene or styrene derivatives and alkyl methacrylates and/or alkyl acrylates, are preferably used.

In the present invention, in order to improve the fixing properties for oil-less fixing toners as well as improving the anti-offset properties, or in order to control the gloss properties for images in full-color toners requiring a light-transmitting properties, it is preferable to use two kinds of binder resins having different softening points as its binder resins. For oil-less fixing toners, the first binder resin having a softening point of 80 to 125° C. is used so as to improve the fixing properties, and the second polyester resin having a softening point of 125 to 160° C. is used so as to improve the anti-offset properties. In this case, if the softening point of the first resin is lower than 80° C., the anti-offset properties are reduced and the reproducibility of dots is reduced, and the softening point exceeding 125° C. fails to provide sufficient effects for improving the fixing properties. If the softening point of the second resin is lower than 125° C., the effects for improving the anti-offset properties become insufficient, and the softening point exceeding 160° C. reduces the fixing properties. For this reason, the softening point of the first resin is more preferably set from 95 to 120° C., preferably 100 to 115° C., and the softening point of the second resin is more preferably set from 130 to 160° C., preferably 135 to 155° C. Glass transition points of the first and second polyester resins are preferably set from 50 to 75° C., preferably from 55 to 70° C. This is because, when the glass transition point is too low, the heat resistance of toner becomes insufficient and when it is too high, the pulverizing performance during manufacturing processes is reduced, resulting in a low production efficiency. The softening point of the second resin is preferably set higher than the softening point of the first resin by not less than 10° C., preferably not less than 15° C.

A ratio of weight of the first resin and the second resin is set at 7:3 to 2:8, preferably 6:4 to 3:7. The application of the first resin and the second resin in such a range provides a superior dot-reproducibility with less toner's expansion due to crushing at the time of fixing and a superior low-temperature fixing properties. This makes it possible to ensure a good fixing properties both in high-speed and low-speed image-forming apparatuses. Moreover, it is possible to ensure a superior dot-reproducibility even in double-sided image-forming processes (in which two passages are made through the fixing device). The ratio of the first resin less than the above-mentioned range makes the low-temperature fixing properties insufficient, and fails to ensure a wide range of fixing properties. The ratio of the second resin less than the above-mentioned range tends to reduce the anti-offset properties and cause toner's expansion due to crushing at the time of fixing, resulting in degradation in the dot-reproducibility.

In the full-color process requiring light-transmitting properties, resins of a sharply-melting type, which have a sharp molecular weight distribution, are conventionally used. The use of such type of resins makes it possible to reproduce glossy and pictorial images. However, in recent years, in color copying normally used in offices, there are increasing demands for images with less degree of gloss. In order to meet such demands, for example, the molecular weight distribution of the resin is widened to the high-molecule side. One of the specific methods for this is to use two or more kinds having different molecular weights in a combined manner. When the resin thus obtained finally through the combination has a glass transition point of 50 to 75° C., a softening point of 80 to 120° C., a number-av-rage molecular weight of 2,500 to 30,000 and a ratio of weight-average molecular weight/number-average molecular weight in the range of 2 to 20, it is preferably adopted. When copied images are desired to have less gloss, the value of the ratio of weight-average molecular weight/number-average molecular weight is set at not less than 4 so that the melt-viscosity curve is tilted. Thus, it becomes possible to expand the gloss-degree controlling-range with respect to the fixing temperature.

Epoxy resins may be preferably used, in particular, in full-color toners. Examples of epoxy resins preferably used in the present invention include polycondensated products of bisphenol A with epichlorohydrin. For example, Epomic R362, R364, R365, R367, R369 (made by Mitsui Sekiyukagaku K.K.), Epotot YD-011, YD-012, YD-014, YD-904, YD-017 (made by Touto Kasei K.K.) and Epi Coat 1002, 1004, 1007 (made by Shell Kagaku K.K.) are commercially available.

In order to improve the anti-offset properties, etc., the toner of the present invention may contain a wax. Examples of such a wax include polyethylene wax, polypropylene wax, carnauba wax, rice wax, sazol wax, montan ester waxes, Fischer-Tropsch wax, etc. In the case of addition of a wax to the toner, the content is preferably in the range of 0.5 to 5 parts by weight relative to 100 parts by weight of the binder resin. Thereby, it becomes possible to obtain the effects of the addition without causing disadvantages, such as filming, etc.

From the viewpoint of improvement in anti-offset properties, polypropylene wax is preferably contained. From the viewpoint of improvements in smear-preventive properties ("smear" means a phenomenon in which, when a paper-sheet with images copied on its one side is fed by an automatic document-feeding apparatus or in a double-sided copying machine, degradation in the copied image, such as blurring and stains, occurs due to friction between the sheets or between the sheet and rollers on the image), polyethylene wax is preferably contained. From the above-mentioned view points, the polypropylene wax is preferably set to have a melt viscosity of 50 to 300 cps at 160° C., a softening point of 130 to 160° C. and an acid value of 1 to 20 KOH mg/g. The polyethylene wax is more preferably set to have a melt viscosity of 1,000 to 8,000 cps at 160° C. and a softening point of 130 to 150° C. The polypropylene wax having the above-mentioned melt viscosity, softening point and acid value exhibits a superior dispersing properties to the binder resin. The anti-offset properties are improved without causing problems due to isolated wax. In particular, when polyester resin is used as the binder resin, oxidized-type waxes are preferably used.

Examples of waxes of oxidized type include oxidized polyolefin waxes, carnauba wax, montan wax, rice wax, and Fischer-Tropsch wax, etc.

With respect to polypropylene waxes which are polyolefin waxes, low molecular weight polypropylene has a small hardness to cause the defect of lowering the toner fluidity. It is preferable that those waxes are modified with carboxylic acid or acid anhydride in order to improve the above defects. In particular, modified polypropylene resins in which a low molecular polypropylene resin is modified with one or more kinds of acid monomers selected from the group consisting of (metha)acrylate, maleic acid and maleic acid anhydride, are preferably used. Such a modified polypropylene may be obtained, for example, by subjecting a polypropylene resin to a graft or addition reaction with one or more kinds of acid monomers selected from the group consisting of (metha) acrylate, maleic acid and maleic acid anhydride in the presence of a peroxide catalyst or without a catalyst. When the modified polypropylene is used, the acid value is set in the range of 0.5 to 30 KOHmg/g, preferably 1 to 20 KOHmg/g.

With respect to the oxidized-type polypropylene waxes, Viscol 200TS (softening point 140° C., acid value 3.5), Viscol 100TS (softening point 140° C., acid value 3.5), Viscol 110TS (softening point 140° C., acid value 3.5), each of which is made by Sanyo Kasei Kogyo K.K., etc., are commercially available.

With respect to oxidized-type polyethylene, commercially available products are: San Wax E300 (softening point 103.5° C., acid value 22) and San Wax E250P (softening point 103.5° C., acid value 19.5), made by Sanyo Kasei Kogyo K.K.; Hi-Wax 4053E (softening point 145° C., acid value 25), 405MP (softening point 128° C., acid value 1.0), 310MP (softening point 122° C., acid value 1.0), 320MP (softening point 114° C., acid value 1.0), 210MP (softening point 118° C., acid value 1.0), 220MP (softening point 113° C., acid value 1.0), 4051E (softening point 120° C., acid value 12), 4052E (softening point 115° C., acid value 20), 4202E (softening point 107° C., acid value 17) and 2203A (softening point 111° C., acid value 30), made by Mitsui Sekiyukagaku K.K., etc.

When carnauba wax is used, the ones of fine crystal particles are preferably used with their acid value preferably in the range of 0.5 to 10 KOHmg/g, preferably 1 to 6 KOHmg/g.

Montan waxes generally refer to montan ester waxes refined from minerals, being in the form of fine crystals as well as carnauba wax; the acid value thereof is preferably in the range of 1 to 20, and more preferably, 3 to 15.

Rice wax is obtained by air-oxidizing rice bran wax, and its acid value being preferably in the range of 5 to 30 KOHmg/g.

Fischer-Tropsch wax is a wax that is produced as a by-product when synthetic oil is produced from coal according to the hydrocarbon-synthesizing method. Such a wax, for example, is available as trade name "sazol wax" made by Sazol K.K. Fischer-Tropsch wax, made from natural gas as a starting material, may be preferably used since it contains less low molecular weight ingredients and exhibits a superior heat resistance when used with toner.

With respect to the acid value of Fischer-Tropsch wax, those having an acid value of 0.5 to 30 KOHmg/g may be used. Among sazol waxes, those of oxidized type having an acid value of 3 to 30 KOHmg/g (trade name: sazol wax A1, A2, etc.) are, in particular, preferably used. Polyethylene wax having the above-mentioned melt viscosity and softening point also exhibits a superior dispersing properties to the binder resin, thereby improving the smear-preventive properties because frictional coefficient of the surface of a fixed image is reduced without causing problems due to isolated wax. The melt viscosity of wax was measured by a viscometer of the Brook Field type.

Known pigments and dyes are used as colorants for full-color toner. Examples of them include carbon black, aniline blue, chalcoil blue, chrome yellow, ultramarine blue, DuPont Oil Red, quinoline yellow, methylene blue chloride, copper phthalocyanine, Malachite green oxalate, Lump Black, Rose Bengal, C.I. Pigment Red 48:1, C.I. Pigment Red 122, C.I. Pigment Red 57:1, C.I. Pigment Red 184, C.I. Pigment Yellow 97, C.I. Pigment Yellow 12, .I. Pigment Yellow 17, C.I. Solvent Yellow 162, C.I. Pigment Yellow 180, C.I. Pigment Yellow 185, C.I. Pigment Blue 15:1, C.I. Pigment Blue 15:3, etc. With respect to black toner, various kinds of carbon black, active carbon and titanium black may be used . The colorant may be replaced partially or all with a magnetic material. For such a magnetic material, for example, known magnetic fine particles such as ferrite, magnetite and iron, may be used. In order to achieve sufficient dispersing properties at the production time, an average particle size of the magnetic particles is preferably not more than 1 $\mu$m, preferably not more than 0.5 $\mu$m.

In the toner of the present invention, additive agents such as a charge-control agent and a mold-releasing agent may be added to its binder resin depending on various purposes. For example, for the charge-control agent, the following compounds may be added: a fluorine surface-active agent, a metal-containing dye such as a metal complex of salicylic acid and an azo-series metal compound, a high molecular acid such as a copolymer containing maleic acid as a monomer component, a quaternary ammonium salt, an azine dye such as nigrosine, carbon black, etc. Magnetic particles, etc. may also be added to the toner of the present invention, if necessary.

In the toner of the present invention, it is preferably to add various organic/inorganic fine particles as fluidity-adjusting agents before a surface-modifying process and/or after a toner-particle preparation. Examples of the inorganic fine particles include various kinds of carbides, such as silicon carbide, boron carbide, titanium carbide, zirconium carbide, hafnium carbide, vanadium carbide, tantalum carbide, niobium carbide, tungsten carbide, chromium carbide, molybdenum carbide, calcium carbide and diamond carbon lactam; various nitrides such as boron nitride, titanium nitride and zirconium nitride; bromides such as zirconium bromide; various oxides, such as titanium oxide, calcium oxide, magnesium oxides, zinc oxide, copper oxide, aluminum oxide, silica and colloidal silica; various titanic acid compounds, such as calcium titanate, magnesium titanate and strontium titanate; sulfides such as molybdenum disulfide; fluorides such as magnesium fluoride and carbon fluoride; various metal soaps, such as aluminum stearate, calcium stearate, zinc stearate and magnesium stearate; and various nonmagnetic inorganic fine particles such as talc and bentonite. These materials may be used alone or in combination. In particular, it is preferable that the inorganic fine particles such as silica, titanium oxide, alumina and zinc oxide are treated by a known method Edith a conventionally used hydrophobisizing agent, such as a silane coupling agent, a titanate coupling agent, silicone oil and silicone vanish, or with a treatment agent, such as a fluorine silane coupling agent or fluorine silicone oil, a coupling agent having an amino group or a quaternary aluminum salt group, and a modified silicone oil.

With respect to the organic fine particles, various organic fine particles, such as styrene particles, (metha)acrylic particles, benzoguanamine, melamine, Teflon, silicon, polyethylene and polypropylene, which are formed into particles by a wet polymerization method such as an emulsion polymerization method, a soap-free emulsion polymerization method and a non-aqueous dispersion polymerization method, and a vapor phase method, etc, may be used. These organic fine particles also works as a cleaning-assist agent.

Inorganic fine particles, such as titanate metal salts, having a comparatively large particle size, and various organic fine particles may be, or may not be subjected to a hydrophobic treatment. An amount of addition of these( fluidizing agents before heat treatment is preferably from 0.1 to 6 parts by weight, preferably from 0.5 to 3 parts by weight, with respect to 100 parts by weight of the developer particles. An amount of addition in the externally adding process after the heat treatment is preferably from 0.1 to 5 parts by weight, preferably from 0.5 to 3 parts by weight. It is preferable to properly adjust the amount of addition before and after the heat treatment.

The above-mentioned binder resin, colorants, and other desired additive agents are mixed, kneaded, pulverized and classified by conventional methods so as to obtain particles having a desired particle size. In the present invention, the particles thus obtained are subjected to an instantaneous heating treatment. The particle size is set in the range of 4 to 10 $\mu$m, preferably 5 to 9 $\mu$m. The particles, obtained at this stage, have virtually the same particle size distribution even after the instantaneous heating treatment.

The classifying process may be carried out after the instantaneous heating treatment of the present invention. It is preferable to use a granulator which allows the pulverized particles to have a spherical shape as a pulverizer used in the pulverizing process. The instantaneous heating treatment, which is to be carried out successively, can be controlled more easily. Examples of such a device include an Inomizer System (made by Hosokawa Micron K.K.), a Criptron System (made by Kawasaki Jyukogyo K.K.), etc. As a classifier used in the classifying process, it is preferable to use such a classifier as to allow the processed particles to have a spherical shape. This makes it easier to control the degree of roundness, etc. Examples of such a classifier include a Teeplex Classifier (made by Hosokawa Micron K.K.).

The instantaneous heating treatment of the present invention may be carried out in combination with various processes in surface-modifying devices for various developers. Examples of these surface-modifying devices include surface-modifying devices using the high-speed gas-flow impact method, such as Hybridization System (made by Narakikai Seisakusho K.K.), Criptron Cosmos System (made by Kawasaki Jyukogyo K.K.) and Inomizer System (made by Hosokawa Micron K.K.), surface-modifying devices using the dry mechanochemical method, such as Mechanofusion System (made by Hosokawa Micron K.K.) and Mechanomill (made by Okadaseikou K.K.), and surface-modifying devices in which the wet coating method is applied, such as Dispacoat (made by Nisshin Engineering K.K.) and Coatmizer (made by Freund Sangyo K.K.). And these devices may be used appropriately in a combined manner.

In the present invention, the instantaneous heating treatment controls the toner particles obtained through the kneading-pulverizing method so as to have a uniform spherical shape, reduces fine pores appearing on the surface of the toner, and increases smoothness. This makes it possible to provide a toner which is superior in uniformity in charging and in image-forming performance, eliminates phenomena such as selective developing in which toner having specific particle size, shape and ingredient in the developer and a specific quantity of charge is first consumed selectively, and achieves a stable image-forming performance for a long time.

Even when applied as a small-particle-size toner which contains as its main component a low-softening-point binder resin that is suitable for a high image-quality, low consumption (coloring material is highly-filled) and a low-energy fixing system, those properties being highly demanded in recent years, and which contains a coloring material at high filing-rate, the toner of the present invention exhibits an appropriate adhesive properties to the toner-supporting members (developing sleeves), the photosensitive member and the transferring members, and also has a superior moving properties. Fluidity is excellent, uniformity in electrical charge is improved, and a stable durability is ensured for a long time.

The instantaneous heating treatment used in the present invention is carried out by spraying and dispersing toner particles into a hot air by using compressed air. The developer is surface-modified by heat. A high degree of roundness and homogeneity that have not been achieved by conventional methods can be achieved.

Figure 2:
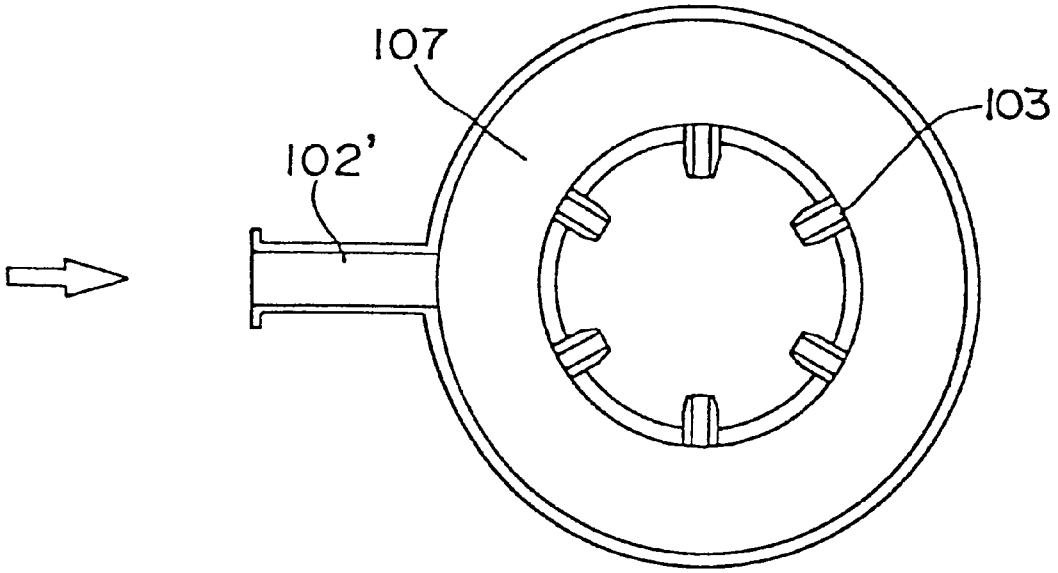
FIG. 2 is horizontal cross-sectional view that schematically shows sample-discharging chamber in the device of FIG. 1.

Referring to schematic views of FIGS. 1 and 2, the following description will discuss the construction of a device that carries out the instantaneous heating treatment.

As illustrated in FIG. 1, high-temperature, high-pressure air (hot air), formed in a hot-air generating device 101, is ejected by a hot-air jetting nozzle 106 through an induction pipe 102. Toner particles 105 are transported by a predetermined amount of pressurized air from a quantitative supplying device 104 through an induction pipe 102', and fed to a sample-ejecting chamber 107 installed around the hot-air ejecting nozzle 106.

As illustrated in FIG. 2, the sample-ejecting chamber 107 has a hollow doughnut shape, and a plurality of sample-ejecting nozzles 103 are placed on its inside wall with the same intervals. The toner particles, sent to the sample-ejecting chamber 107, are allowed to spread inside the ejecting chamber 107 in a uniformly dispersed state, and discharged through the sample-ejecting nozzles 103 into the hot air flow by the pressure of air successively sent thereto.

It is preferable to provide a predetermined tilt to the sample-ejecting nozzles 103 so as not to allow the discharging flow from each sample-ejecting nozzle 103 to cross the hot air flow. More specifically, the ejection is preferably made so that the toner-ejecting flow runs along the hot air flow to a certain extent. An angle formed by the toner ejecting flow and the direction of the central flow of the hot air flow is preferably set in the range of 20 to 40°, preferably 25 to 35°. The angle wider than 40° causes the toner ejecting flow to cross the hot air flow, resulting in collision with toner particles discharged from other nozzles and the subsequent aggregation of the toner particles. The angle narrower than 20° left some toner particles not being taken in the hot air flow, resulting in irregularity in the toner particle shape.

A plurality of the sample-ejecting nozzles 103, preferably at least not less than 3, more preferably not less than 4 are required. The use of a plurality of the sample-ejecting nozzles makes it possible to uniformly disperse the toner particles into the hot air flow, and to ensure a heating treatment for each of the toner particles. With respect to the ejected state from the sample-ejected nozzle, it is desirable that the toner particles are widely scattered at the time of ejection and dispersed to the entire hot air flow without collision with other toner particles.

The toner particles, thus ejected, are allowed to contact with the high-temperature hot air instantaneously, and subjected to a heating treatment uniformly. "Instantaneously" refers to a time period during which a required toner-particle improvement (heating treatment) has been achieved without causing aggregation between the toner particles; and although it depends on the processing temperature and the density of toner particles in the hot air flow, this time period is normally set at not more than 2 seconds, preferably not more than 1 second. This instantaneous time period is represented as a residence time of toner particles from the time when the toner particles are ejected from the sample-ejecting nozzles to the time when they are transported into the induction pipe 102". The residence time exceeding 2 seconds is likely to cause bonding of particles.

The toner particles, which have been instantaneously heated, are cooled off by a cold air flow introduced from a cooling-air induction section 108, and collected into a cyclone 109 through the induction pipe 102"without adhering to the device walls and causing aggregation between particles, and then stored in a production tank 111. The carrier air from which the toner particles have been removed is allowed to pass through a bug filter 112 by which fine powder is removed therefrom, and released into the air through a blower 113. The cyclone 109 is preferably provided with a cooling jacket through which cooling water runs, so as to prevent aggregation of toner particles.

In addition, important conditions for carrying out the instantaneous heating treatment include an amount of hot air, an amount of dispersing air, a dispersion density, a processing temperature, a cooling air temperature, an amount of suction air and a cooling water temperature.

The amount of hot air refers to an amount of hot air supplied by the hot-air generating device 101. The greater the amount of hot air, the better in an attempt to improve the homogeneity of the heating treatment and the processing performance.

The amount of dispersing air refers to an amount of air that is to be sent to the induction pipe 102' by the pressurized air. Although it also depends on other conditions, the amount of dispersing air is preferably suppressed during the heating treatment. Dispersing state of toner particles are improved and stabilized.

The dispersion density refers to a dispersion density of toner particles in a heating treatment area (more specifically, a nozzle-jetting area). A preferable dispersion density varies depending on the specific gravity of toner particles; and the value obtained by dividing the dispersion density by the specific gravity of toner particles is preferably set in the range of 50 to 300 $g/m^3$, preferably 50 to 200 $g/m^3$.

The processing temperature refers to a temperature within the heating treatment area. In the heating treatment area, a temperature gradient spreading outwards from the center actually exists, and it is preferable to reduce this temperature distribution at the time of the heating treatment. It is preferable from the viewpoint of device mechanism to supply an air flow in a stable layer-flow state by using a stabilizer, etc. In the case of a non-magnetic toner containing a binder resin having a sharp molecular-weight distribution, for example, a binder resin having a ratio of weight-average molecular weight/number-average-molecular weight of 2 to 20, it is preferable to carry out the heating treatment in a peak-temperature range between the glass transition point of the binder resin +100° C. and the glass transition point thereof +300° C. It is more preferable to carry it out in a peak-temperature range between the glass transition point of the binder resin +120° C. and the glass transition point thereof +250° C. The peak temperature range refers to a maximum temperature in the area in which the toner contacts with the hot air.

In the case of a non-magnetic toner containing a binder resin having a relatively wide molecular-weight distribution, for example, a binder resin having a ratio of weight-average molecular weight/number-average molecular weight of 30 to 100, it is preferable to carry out the heating treatment in a peak-temperature range between the glass transition point of the binder resin +100° C. and the glass transition point thereof +300° C. It is more preferable to carry it out in a peak-temperature range between the glass transition point of the binder resin +150° C. and the glass transition point thereof +280° C. The reason for this is that, in order to improve the shape and surface homogeneity of the toner, it is necessary to apply a high processing temperature so that even the high molecular portion of the binder resin can be modified. However, the setting of the high processing temperature, in contrast, tends to produce bonded particles; therefore, some adjustment of conditions may be required. For example, an amount of a fluidizing agent prior to the heating treatment has to be set higher, or the dispersion density is set lower at the time of the treatment, etc.

When wax is added to the toner particles, particles are more likely to bond. For this reason, some adjustment of conditions may be required. For example, an amount of a fluidizing agent (especially, fluidizing agent having a large particle size) prior to the heating treatment is set higher. The dispersion density is set lower at the time of the treatment, etc. These adjustments are significant to obtain uniform toner particles with shape-irregularity suppressed. These operations are particularly important when a binder resin having a relatively wide molecular weight distribution is used or when the processing temperature is set to a high level in order to heighten the degree of roundness.

The cooling air temperature refers to a temperature of cold air introduced from the cooling-air introduction section 108. The toner particles, after having been subjected to an instantaneous heating treatment, are preferably placed in an atmosphere of a temperature not more than the glass transition point by using cold air so as to be cooled to a temperature range which causes no aggregation or bonding of the toner particles. Therefore, the temperature of the cooling air is set at not more than 25° C., preferably not more than 15° C., more preferably not more than 10° C. However, an excessively lowered temperature might cause dew condensation in some conditions and adverse effects; this must be noted. In the instantaneous heating treatment according to the invention, together with a cooling effect by cooling water in the device as will be described next, since the time in which the binder resin is in a fused state is kept very short, it is possible to eliminate aggregation between the particles and adhesion of the particles to the device walls of the heat treatment device. Consequently, it becomes possible to provide superior stability even during continuous production, to greatly reduce the frequency of cleaning for the manufacturing devices, and to stably maintain the yield high.

The amount of suction air refers to air used for carrying the processed toner particles to the cyclone by the blower 113. The greater the amount of suction air, the better in reducing the aggregation of the toner particles.

The temperature of cooling water refers to the temperature of cooling water inside the cooling jacket installed in the cyclones 109 and 114 and in the induction pipe 102". The temperature of cooling water is set at not more than 25° C., preferably not more than 15° C., more preferably not more than 10° C.

In order to maintain a high degree of sphericity (degree of roundness) and to reduce irregularity in shape, it is preferable to further take the following measures.

(1) The amount of toner particles to be supplied to the hot air flow is kept constant without generating pulsating movements, etc. For this purpose;

(i) a plurality of devices, such as a table feeder 115 shown in FIG. 1 and a vibration feeder, are used in combination so as to improve the quantitative supplying properties. If a high-precision quantitative supply is achieved by using a table feeder and a vibration feeder, finely-pulverizing and classifying processes can be connected thereto so that toner particles can be supplied on-line to the heating treatment process;

(ii) After having been supplied by compressed air, prior to supplying toner particles into hot air, the toner particles are re-dispersed inside the sample-supplying chamber 107 so as to enhance the dispersion uniformity. For example, the following measures are adopted: the re-dispersion is carried out by using secondary air; the dispersed state of the toner particles is uniformed by installing a buffer section; and the re-dispersion is carried out by using a co-axial double tube nozzle, etc.

(2) When sprayed and supplied into a hot air flow, the dispersion density of the toner particles is optimized and controlled uniformly.

For this purpose;

(i) the supply into the hot air flow is carried out uniformly, in a highly dispersed state, from all circumferential directions. More specifically, in the case of supply from dispersion nozzles, those nozzles having a stabilizer, etc. are adopted so as to improve the dispersion uniformity of the toner particles that are dispersed from each of the nozzles;

(ii) In order to uniform the dispersion density of the toner particles in the hot air flow, the number of nozzles is set to at least not less than 3, preferably not less than 4, as described earlier. The greater the number, the better, and these nozzles are arranged symmetrically with respect to all the circumferential directions. The toner particles may be supplied uniformly from slit sections installed all the 360-degree circumferential areas;

(3) Control is properly made so that no temperature distribution of the hot air is formed in the processing area of toner particles so as to apply uniform thermal energy to each of the particles, and the hot air is maintained in a layer-flow state.

For this purpose;

(i) the temperature fluctuation of a heating source for supplying hot air is reduced.

(ii) A straight tube section preceding the hot-air supplying section is made as long as possible. Alternatively, it is preferable to install a stabilizer in the vicinity of the hot-air supplying opening so as to stabilize the hot air. Moreover, the device construction, shown in FIG. 1 as an example, is an open system; therefore, since the hot air tends to be dispersed in a direction in which it contacts with outer air, the supplying opening of the hot air may be narrowed on demands.

(4) The toner particles are subjected to a sufficient fluidizing treatment so as to be maintained in a uniform dispersed state during the heating treatment.

For this purpose, (i) in order to maintain sufficient dispersing and fluidizing properties of the toner particles, inorganic fine particles (first inorganic fine particle) having a BET specific surface area of 100 to 350 $m^2/g$, preferably 130 to 300 $m^2/g$ are preferably used. It is preferable for these inorganic fine particles to be subjected to a hydrophobic treatment by a known hydrophobic agent. An amount of addition of the inorganic fine particles is set to 0.1 to 6 parts by weight, and preferably 0.3 to 3 parts by weight with respect to 100 parts by weight of toner particles.

(ii) In a mixing process for improving the dispersing and fluidizing properties, each of the fine particles is preferably located on the surface of the toner particle uniformly in an adhering state without being firmly fixed thereon.

(5) Even when the surface of the toner particle is subjected to heat, particles which have not been softened are located on the surface of the toner particle so that a spacer effect is maintained between the toner particles.

For this purpose, (i) it is preferable to add fine particles that have a particle size relatively larger than that of the inorganic fine particles shown in (4) and are not softened at the treating temperature. The existence of the fine particles on the surface of the toner particle prevents the toner particle surface from forming an entire resin-surface after starting heat-applying, thereby providing the spacer effect between the toner particles and also preventing aggregation and bonding between the toner particles.

(ii) In order to achieve such effects, inorganic fine particles (second inorganic fine particle) having a BET specific surface area of 10 to 100 $m^2/g$, preferably 20 to 90 $m^2/g$, more preferably 20 to 80 $m^2/g$, are used. An amount of addition of the inorganic fine particles is set to 0.05 to 5 parts by weight, preferably 0.3 to 3 parts by weight with respect to 100 parts by weight of toner particles.

In the case where the first inorganic fine particles and the second inorganic fine particles are used in combination, the difference between the BET specific surface areas of the two is set to not less than 30 $m^2/g$, preferably not less than 50 $m^2/g$.

(6) The collection of the heat-treated product is controlled so as not to generate heat.

For this purpose;

(i) the particles that are subjected to the heat treatment and cooling process are preferably cooled in a chiller in order to reduce heat generating in the piping system (especially, in R portions) and in the cyclone normally used in the collection of the toner particles.

(7) In the case of a process using magnetic toner having a relatively greater specific gravity with a small amount of resin component that contributes to the heating treatment, it is preferable to surround the heat-treating space in a cylinder shape so as to increase the time during which the treatment is virtually carried out, or to carry out a plurality of the treatments.

When toner particles are dispersed and sprayed into hot air so as to be subjected to an instantaneous heating treatment in a manner as described above, the resultant non-magnetic color toner and oil-less fixing toner have surface characteristics that satisfy the following formula [I]:

$$D/d_{50} \leqq 0.40, \text{ where } D=6/(\rho \cdot s) \quad [I]$$

(in the formula [I], D represents a converted particle size ($\mu$m) from the specific surface area obtained when it is supposed that the toner shape is spherical; $d_{50}$ is a particle size ($\mu$m) corresponding to 50% of the relative weight distribution classified by particle sizes; ρ is a true density of toner ($g/cm^3$); and S is a BET specific surface area ($m^2/g$)). $D/d_{50}$, is preferably set in the range of 0.40 to 0.80, preferably from 0.45 to not less than 0.70.

In the case of magnetic toner, since magnetic particles are included inside the toner particles, the lower limit value of $D/d_{50}$ is set as compared with non-magnetic toner, and those having a value of not less than 0.20 are used. The preferable range of $D/d_{50}$ of the magnetic toner is from 0.20 to 0.55, preferably 0.25 to 0.50.

This $D/d_{50}$, is an index indicating whether or not pores exist on the surface or the inside of the toner particle. If the toner satisfies the above-mentioned value, it is possible to avoid problems in which: toner cracking occurs centered on the pore portion, silica etc., which are fluidizing agents added externally, are embedded into the recessed portions, and protruding portions are ground to cause fine powder.

For the purpose of forming appropriate protruding portions on the surface of the toner by externally adding inorganic fine particles to the toner particles so as to improve the charging properties of the toner, in the case of non-magnetic toner, $D/d_{50}$, is preferably set to not more than 0.80, and in the case of magnetic toner, $D/d_{50}$ is preferably set to not more than 0.55.

When the toner, obtained as described above, is used in a mono-component developing method, that is, a developing method in which the developer is allowed 1lo pass through the gap between the developer-transferring and supporting member and the developer-regulating blade placed in contact with the developer-transferring member so that a toner thin layer is formed on the supporting member, charged, and transported as it is to the electrostatic latent image-developing area so as to develop the electrostatic latent image formed on the electrostatic latent image-supporting member, it is possible to prevent the toner from cracking and also to provide stable durability even if high-speed copying is repeated. However, in the case of the spherical toner used in the present invention that has superior uniformity in the shape and characteristics, since the toner is less susceptible to powder stress in the vicinity of the developer-regulating section, with the result that it is difficult for the toner to enter the gap between the developer-transferring and supporting member and the developer-regulating blade. Therefore, in the present invention, the surface roughness of the peripheral surface of the developer-transferring and supporting member and the toner weight-average particle diameter $d_{50}$ are adjusted to satisfy the relationship, $0.6 \leqq (d_{50}/Ra) \leqq 3.0$, preferably $0.7 \leqq (d_{50}/Ra) \leqq 2.5$, thereby improving the feeding properties of the spherical toner.

The relationship ($d_{50}$/Ra) not more than 0.6 causes failure in electrical charging due to excessive transferring, and the relationship ($d_{50}$/Ra) not less than 3.0 causes insufficient feeding of the toner to the developer-transferring and supporting member, insufficient transferring and degradation in solid-portion reproducibility.

Ra refers to average roughness of center line described in Japanese Industrial Standard (JIS) B0601-1982.

Toner is obtained by externally admixing post-treating agents such as a fluidizing agent etc. to the toner particles obtained as described above. With respect to the post-treating agents, inorganic fine particles or organic fine particles may be used. It is preferable to use inorganic fine particles having a BET specific surface area of 1 to 350 $m^2/g$ as the post-treating agents. In order to improve the fluidity of the toner, it is preferable to use those having a BET specific surface area of 100 to 350 $m^2/g$, preferably 130 to 300 $m^2/g$, as the inorganic fine particles for post-treatment. These inorganic fine particles are preferably subjected to a hydrophobic treatment by a known hydrophobic agent. An amount of addition of the inorganic fine particles is in the range between 0.1 and 3% by weight, preferably 0.3 and 1% by weight with respect to the toner particles.

In order to improve the toner's environmental stability and endurance stability, those having a BET specific surface area of 1 to 100 $m^2/g$, preferably 5 to 90 $m^2/g$, more preferably 5 to 80 $m^2/g$ are used as the inorganic fine particles for the post-treatment. An amount of addition of the inorganic fine particles is set to 0.05 to 5% by weight, preferably 0.3 to 2% by weight, with respect to the toner particles.

In the case when the inorganic fine particles for improving fluidity and the inorganic fine particles for improving stability are used in combination, the difference between the BET specific surface areas of the two is adjusted to not less than 30 $m^2/g$, preferably not less than 50 $m^2/g$.

An explanation will be given of a mono-component contact-developing method by exemplifying a full-color image-forming apparatus shown in FIG. 3. In the full-color image-forming apparatus, a photosensitive member is used as the image-supporting member, an endless intermediate transfer belt is used as the intermediate transfer member, and a sheet of recording paper is used as the recording member.

Figure 3:
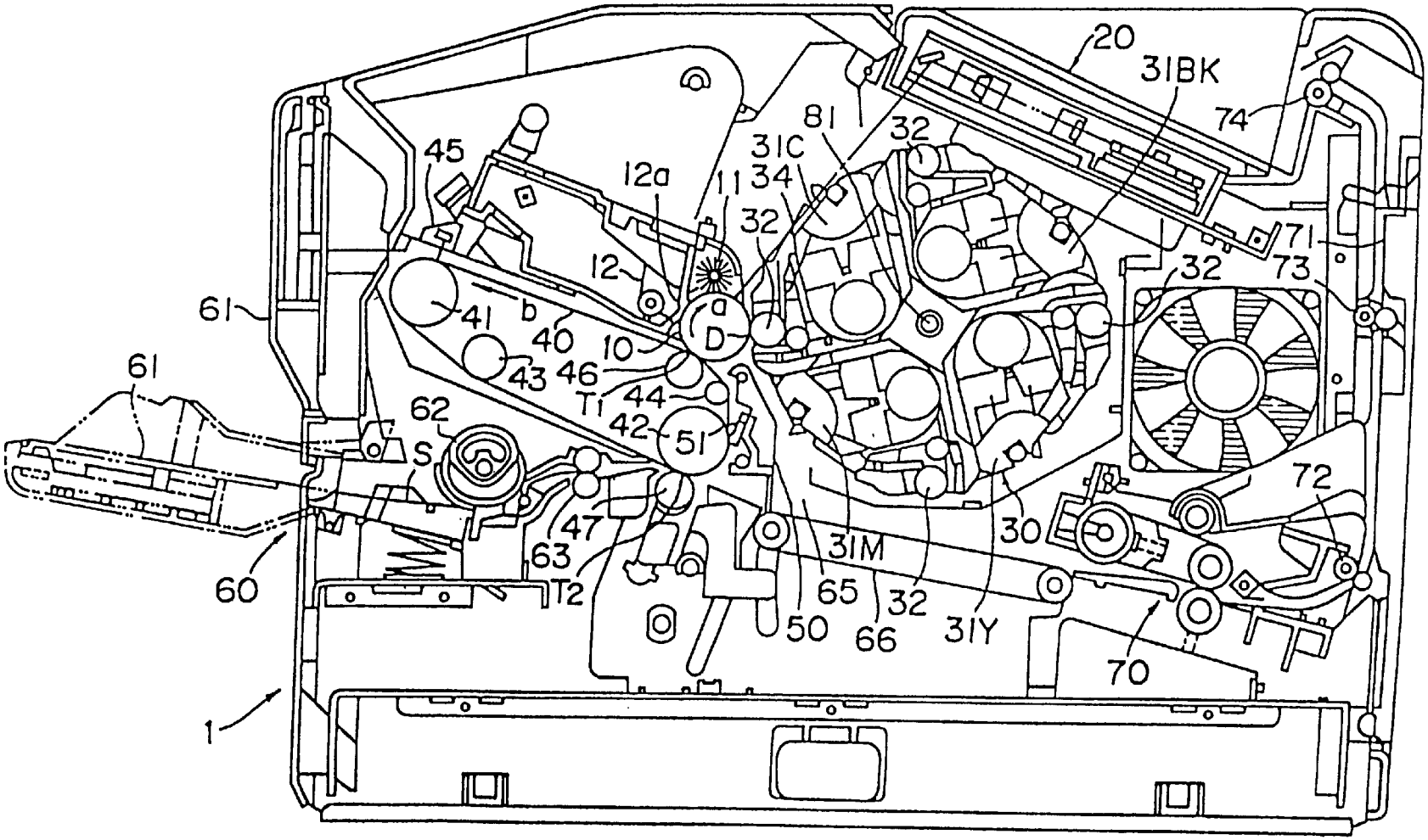
FIG. 3 is a schematic constitutional view of full-color image-forming apparatus.

In FIG. 3, the full-color image-forming apparatus is schematically constituted by a photoconductive drum 10 that is rotationally driven in the arrow a direction, a laser scanning optical system 20, a full-color developing device 30, an endless intermediate transfer belt 40 that is rotationally driven in the arrow b direction, and a paper-feed section 60. On the periphery of the photoconductive drum 10 are further installed a charging blush 11 for charging the surface of the photoconductive drum 10 to a predetermined electric potential, and a cleaner 12 having a cleaner blade 12*a* for removing toner remaining on the photoconductive drum 10.

The laser scanning optical system 20 is a known system equipped with a laser diode, a polygon mirror and an f□ optical element, and its control section receives print data classified into C(cyan), M(magenta), Y(yellow) and Bk(black) from a host computer. The laser scanning optical system 20 outputs print data for the respective colors successively as laser beams, thereby scanning and exposing the photoconductive drum 10. Thus, electrostatic latent images for the respective colors are successively formed on the photoconductive drum 10.

The full-color developing device 30 is integrally provided with four developing devices 31Y, 31M, 31C and 31Bk separated for housing the non-magnetic toners Y, M, C and Bk respectively, and is allowed to rotate clockwise on a supporting shaft 81 as a supporting point. Each developing device has a developing sleeve 32 and a toner regulating blade 34. Toner, which is fed by the rotation of the developing sleeve 32, is charged when it is allowed to pass through a contact section (gap) between the blade 34 and the developing sleeve 32.

With respect to the installation positions of the developing devices housing the respective toners, or yellow toner, magenta toner, cyan toner and black toner, the(se positions are dependent on purposes of copying processes, that is, whether the purpose of the full-color image-forming apparatus is to copy line and graphic images such as characters or to copy images having gradations in respective colors such as photographic images. For example, in the case of copying of line and graphic images such as characters, a kind of toner having no gloss properties (luster) is used as black toner, and in this case, when the black toner layer is formed as the uppermost layer on a full-color copied image, inconsistency appears thereon; therefore, the black toner is preferably attached to the developing device so as not to form the black toner layer as the uppermost layer on a full-color copied image. It is most preferable to attach the black toner so that the black toner layer is formed as the lowermost layer on copied images, that is, so that, in the primary transfer process, the black toner layer is formed as the uppermost layer on the intermediate transfer member. Therefore, the yellow toner, magenta toner, and cyan toner (color toners) are attached to the developing device arbitrarily so that in the primary transfer process, each of the layers is formed as any of the first through third layers in the order of formation thereof.

In the case where the full-color image-forming apparatus is used for copying images having gradations in respective colors such as photographic images, a kind of toner having gloss properties (luster) is used as black toner. Even when the black toner layer is formed as the uppermost layer on a full-color copied image, no inconsistency with the other color-toner layers appears thereon.

The intermediate transfer belt 40 is mounted over support rollers 41 and 42 and tension rollers 43 and 44 in an endless from, and is rotationally driven in the arrow b direction in synchronism with the photoconductive drum 10. A protrusion (not shown) is placed on the side of the intermediate transfer belt 40, and a micro-switch 45 detects the protrusion so that the image-forming processes, such as exposure, developing and transferring, are controlled. The intermediate transfer belt 40 is pressed by a primary transfer roller 46 that is freely rotatable so as to come into contact with the photoconductive drum 10. This contact section forms a primary transfer section $T_1$. Moreover, the intermediate transfer belt 40 comes into contact with a secondary transfer roller 47 that is freely rotatable at its portion supported by the support roller 42. This contact portion forms a secondary transfer section $T_2$.

A cleaner 50 is installed in a space between the developing device 30 and the intermediate transfer belt 40. The cleaner 50 has a blade 51 for removing residual toner from the intermediate transfer belt 40. This blade 51 and the secondary transfer roller 47 are detachably attached to the intermediate transfer belt 40.

The paper-feed section 60 is constituted by a paper-feed tray 61 that is freely opened on the front side of the image-forming apparatus main body 1, a paper-feed roller 62 and a timing roller 63. Recording sheets S are stacked on the paper-feed tray 61, and fed to the right in the FIG. one sheet by one sheet in accordance with the rotation of the paper-feed roller 62, and then transported to the secondary transfer section in synchronism with an image formed on the intermediate transfer belt 40 by the timing roller 63. A horizontal transport path 65 for recording sheets is constituted by an air-suction belt 66, etc. with the paper-feed section being included therein, and a. vertical transport path 71 having transport rollers 72, 73 and 74 extends from the fixing device 70. The recording sheets S are discharged onto the upper surface of the image-forming apparatus main body 1 from this vertical transport path 71.

Next, an explanation will be given of the printing process of the full-color image-forming apparatus.

When a printing process is started, the photoconductive drum 10 and the intermediate transfer belt 40 are rotationally driven at the same peripheral velocity, and the photoconductive drum 10 is charged to a predetermined electric potential by the charging brush 11.

Successively, exposure for a cyan image is carried out by the laser scanning optical system 20 so that an electrostatic latent image of the cyan image is formed on the photoconductive drum 10. This electrostatic latent image is directly developed by the developing device 31C, and the toner image is transferred onto the intermediate transfer belt 40 at the primary transfer section. Immediately after the completion of the primary transferring process, switching is made to the developing device 31M in the developing section D, and successively, exposure, developing and primary transferring processes are carried out for a magenta image. Switching is further made to the developing device 31Y, and exposure, developing and primary transferring processes are carried out for a yellow image. Switching is further made to the developing device 30 Bk, and exposure, developing and primary transferring processes are carried out for a black image. Thus, the toner images are superimposed one by one on the intermediate transfer belt 40 for the respective primary transferring processes 1.

When the final primary transferring process is completed, a recording sheet S is sent to the secondary transfer section, and a full-color toner image, formed on the intermediate transfer belt 40, is transferred onto the recording sheet S. Upon completion of this secondary transferring process, the recording sheet S is transported to a belt-type contact-heating fixing device 70 where the full-color toner image is fixed onto the recording sheet S; then, the recording sheet S is discharged onto the upper surface of the printer main body.

Figure 4:
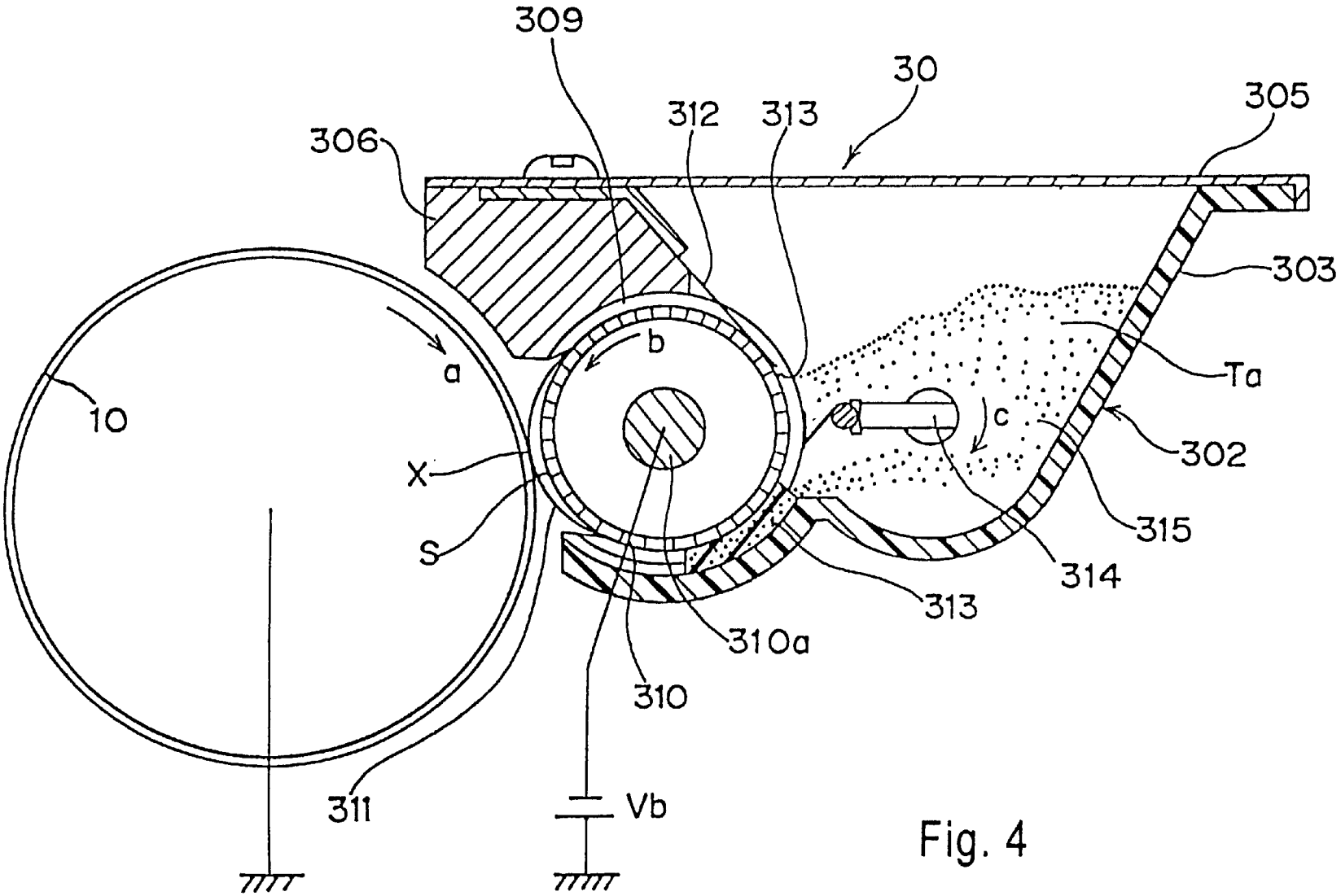
FIG. 4 is a schematic constitutional view of developing device.

Referring to FIG. 4, the following description will discuss in detail; the positional relationship between the photosensitive drum 10 and the full-color developing device 30 and the schematic construction of the developing device in the full-color image-forming apparatus shown in FIG. 3.

In the Figure, the developing device (30) is installed on the side of the photosensitive drum (10) which is rotationally driven in the direction of arrow (a).

Figure 5:
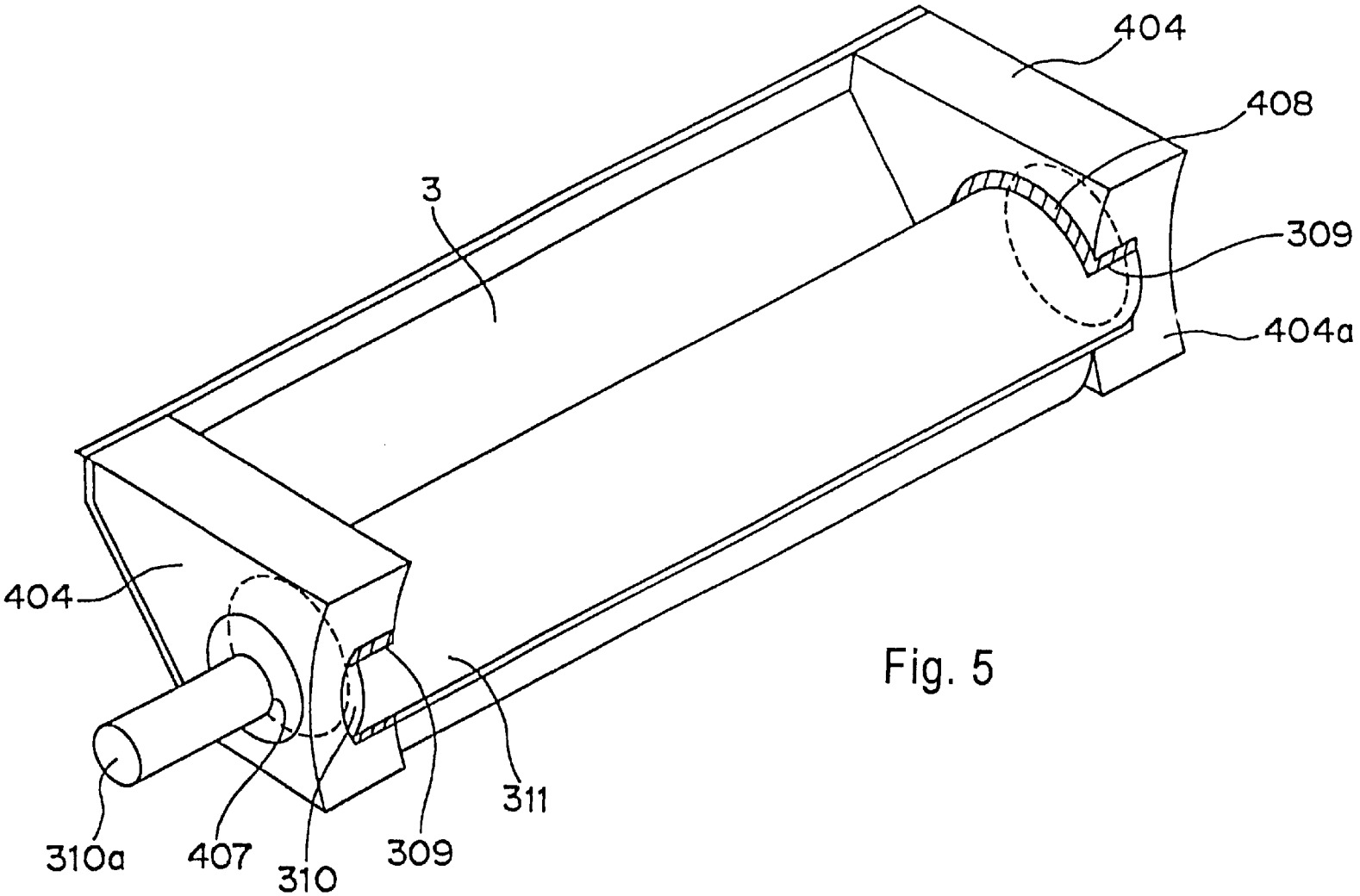
FIG. 5 is a schematic constitutional relationship of developing roller with thin film mounted thereon.

In the developing device (30), a developing vessel (302) is constituted of a frame (303) that covers the bottom section and the back face section, side plates (404) on both sides ((404) see FIG. 5), a cover (305) and a support section (306) that is attached to the front portion of the cover (305).

A developing roller (310) is constituted of a metal roller having a conductive elastic material (silicone rubber) attached to the peripheral portion thereof. A developing bias voltage (Vb) is applied thereto.

Figure 6:
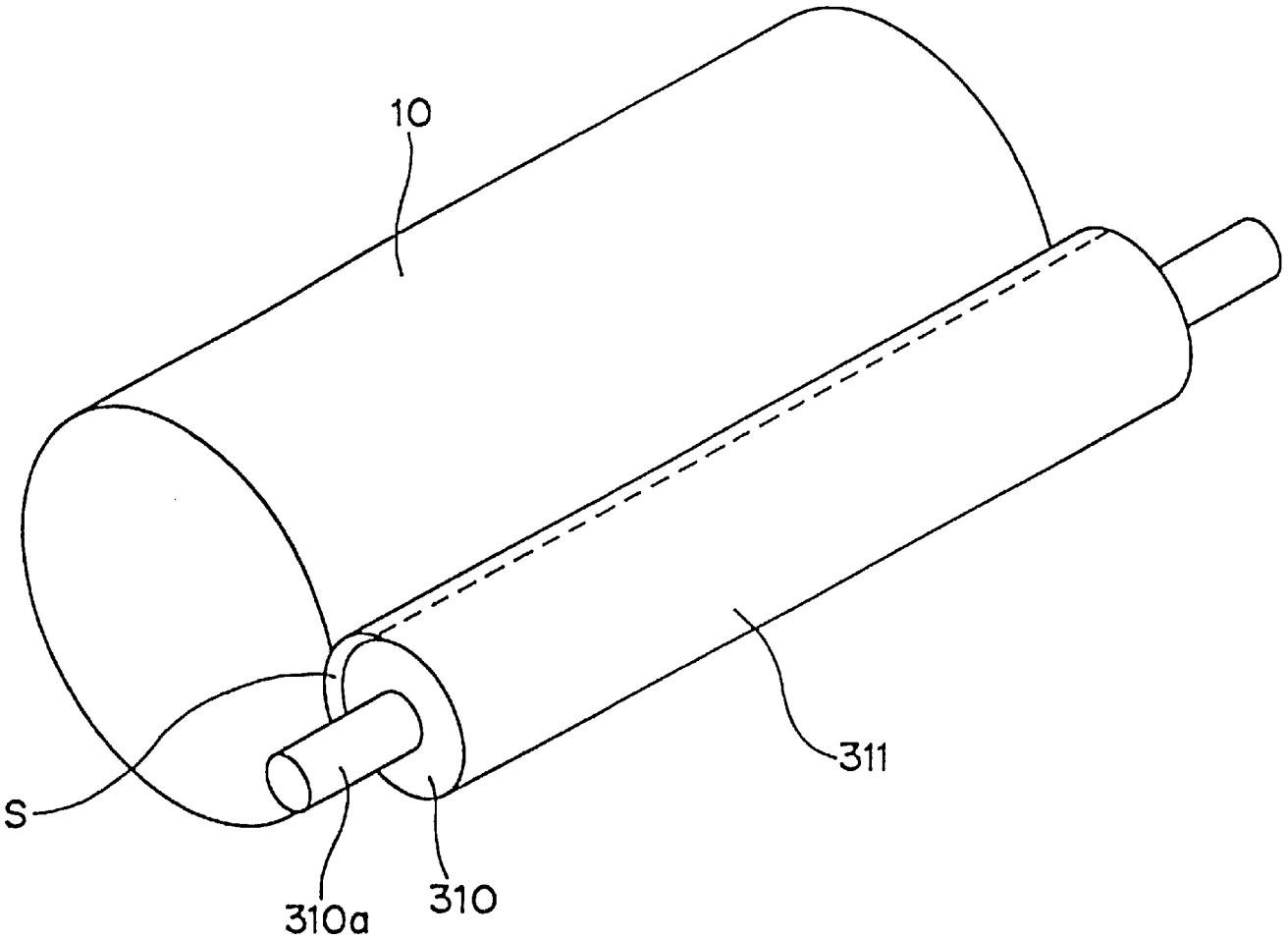
FIG. 6 is a schematic constitutional relationship between developing roller and photosensitive drum.

A thin film member (311), which has a cylinder shape having a peripheral length slightly longer than the peripheral length of the developing roller (310), is externally attached to the developing roller (310) as illustrated in FIG. 6. The thin film member (311) is composed of a sheet made of soft resin of nylon to which carbon is added.

In the present invention, this thin film member has a surface roughened so as to satisfy the relationship $0.6 \leqq (d_{50}/Ra) \leqq 3.0$. This roughened surface, which is achieved by preliminarily roughening a surface of a mold for forming the thin film member to a predetermined roughness, can be adjusted by adjusting the degree of roughness of the mold, and can be set so as to satisfy the above-mentioned relationship by taking into consideration the weight-average particle size of toner to be loaded into the developing device.

As illustrated in FIG. 5, the developing roller (310) to which the thin film member (311) has been attached is rotatably supported by inserting a support shaft **(310*a*) through supporting holes (407) of the side plates (404) (one of them, not shown), and connected to a driving source(not shown), so as to be driven. Both of the ends of the developing roller (310) are placed at recessed sections (408) formed in the side plates (404). Guide elastic pads (309) intervenes between the recessed section (408) and the thin film member (311) externally attached to the developing roller (310) at the both-end so as to make the thin film member (311) in contact with the peripheral surface of the developing roller (310). Each of elastic pads (309)** is comprised of a foamed member having a surface to which the aforementioned polyester film is attached.

The recessed sections (408) are opened on the photosensitive drum (10) side through the front face **(404*a*) of the side plates (404), and no elastic pads (309)** exist on these portions.

Therefore, portions of the thin film member (311) which contact with the elastic pads (309) are made in contact with the peripheral surface of the developing roller (310). At the other portion, that is, the potion located on the front faces **(404*a*) of the side plates (404), excessive length portions of the thin film member (311) which has a peripheral length slightly longer than that of the developing roller (310) are concentrated so that a space (S) is formed between the thin film member (311) and the developing roller (310). The peripheral surface of the thin film member (311) covering the space (S) is allowed to contact with the peripheral surface of the photosensitive drum (10)**.

With respect to the elastic pads (309), the developing roller (310) and the thin film member (311), these members are selected so that, supposing that the kinematic friction coefficient between the peripheral surface of the developing roller (310) and the inner circumferential surface of the thin film member is $\nu_1$ and that the kinematic friction coefficient between the peripheral surface of the thin film member (311) and the elastic pads (309) is $\nu_2$, the relationship, $\nu_1 > \nu_2$, is satisfied.

For this reason, when the developing roller (310) is rotated in the direction of arrow (b), the thin film member (311) is driven following the rotation without slipping on the developing roller (310). The peripheral surface of the thin film member (311) covering the space (S) is allowed to contact with the surface of the photosensitive drum (10) with an appropriate nip width.

A blade (312) is attached onto the back face side of the supporting member (306) installed on the upper portion of the developing roller (310). The blade (312) is pressed onto the developing roller (310) diagonally on its upper portion on the back face side through the thin film member (311). The blade (312) is constituted of a thin metal plate having a spring properties made of SUS.

A toner smoothing pad (313), which has a surface formed by an elastic layer made of foamed urethane to which a silicone rubber sheet is affixed, is attached to a portion of the frame (303) facing the developing roller (310). This toner smoothing pad (313) is allowed to contact with the peripheral surface of the developing roller (310) through the thin film member (311).

A toner housing vessel (315) is formed at the rear section of the developing vessel (302). An agitator (314) is attached to the toner housing vessel (315) so as to be rotatably driven in the direction of arrow (c). The agitator (314) feeds toner (To) stored in the toner housing vessel (315) in the direction of arrow (c) while preventing its blocking, etc.

The following description will explain the motion of the developing device (30) having the above-mentioned construction.

While the developing roller (310) and the agitator (314), driven by a driving source (not shown), are rotating in the respective directions of arrows (b) and (c), the toner (To) inside the toner housing vessel (315) is stirred by the agitator (314) and shifted forcedly in the direction of arrow (c).

The thin film member (311) is driven in the direction of arrow (b) by a frictional force exerted between it and the developing roller (310). The toner (To) contacting with the thin film member (311) is transferred in the direction of arrow (b) through the contact with the thin film member (311) and an electrostatic force. The toner (To) is taken in at a wedge-shaped intake section (313) formed by the thin film member (311) and the blade (312). When the toner reaches the pressing section of the blade (312), the toner is uniformly applied to the surface of the thin film member (311) in a manner so as to form a thin layer, while being frictionally charged.

The toner (To) held on the thin film member (311) is transferred to a section (developing area (X)) opposing to the photosensitive drum (10) in accordance with the movement of the thin film member (311) that is driven by the developing roller (310). The toner adheres to an electrostatic latent image formed on the surface of the photosensitive drum (10) in accordance with a difference in voltage between the surface electric potential of the photosensitive drum (10) and a bias voltage applied to the developing roller (310). Toner images are formed.

In this case, the thin film member (311) contacting with the photosensitive drum (10) is in a non-contacting state to the developing roller (310) through the space (S) so that the thin film member (311) is allowed to contact with the photosensitive drum (10) softly with an appropriate nip width without irregularity. Thus, a uniform toner image is formed onto the electrostatic latent image on the photosensitive drum (10). In the case where a difference in velocity is provided between the peripheral velocity of the photosensitive drum (10) and the velocity of the thin film member (311), it becomes possible to eliminate fog in the non-image portion. Even in this case, the toner image, once formed on the photosensitive drum (10), is not damaged.

The toner (To), which passed through the developing area (X), is continuously transferred in the direction of arrow (b) together with the thin film member (311). When the toner passes through the gap between the toner smoothing pad (313) and the film member, a consumed pattern of toner (To) that was consumed previously at the developing area (X) is erased and the toner layer is reformed uniformly.

Then, a uniformly charged thin toner layer is formed on the surface of the thin film member (311) again at the pressing section of the blade (312). Thereafter, the same operation is repeated.

An explanation will be given of a mono-component non-contact developing method using a non-magnetic toner by exemplifying a developing device shown in FIG. 7.

Figure 7:
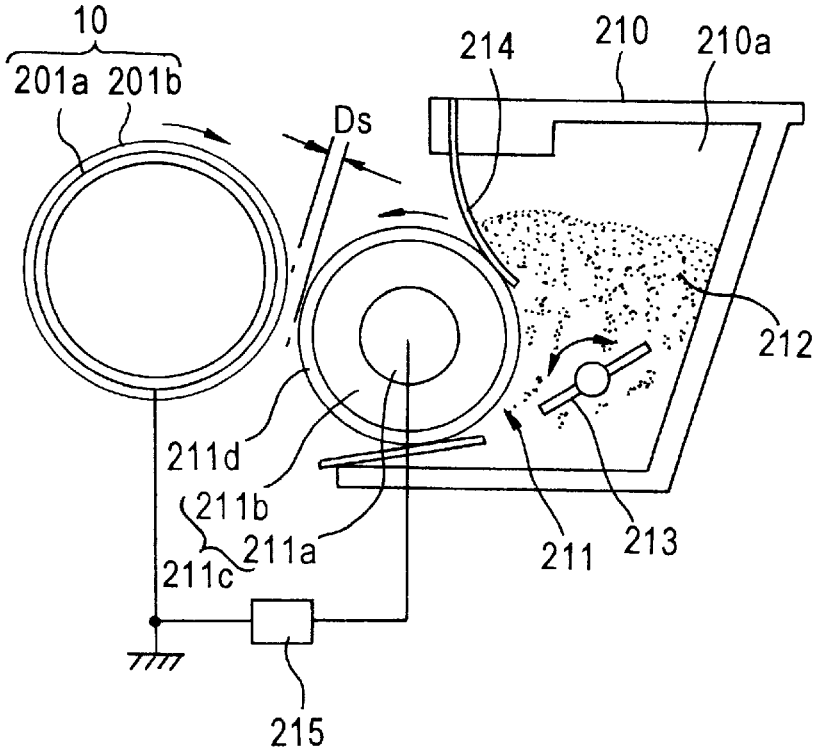
FIG. 7 is a schematic view of structure of mono-component non-contact developing device for non-magnetic toner.

As illustrated in FIG. 7, an image-supporting member 10, constituted of a photosensitive drum in which a photosensitive layer 201*b* is formed on the surface of a conductive supporting member 201*a* having a cylinder shape, is used. After the surface of the image-supporting member 10 is charged by a charging device (not shown), the surface of the image-supporting member 10 is irradiated with light by an appropriate exposing device (not shown) so that an electrostatic latent image in accordance with image information is formed on the surface of the image-supporting member 10.

Then, a developer-supporting member 211 is used in which a high resistant layer 211*d* is formed on the surface of a conductive base 211*c* that is constituted of a conductive rotary shaft 211*a* around which a conductive elastic layer 211*b* is formed. This developer-supporting member 211 is aligned face to face with the image-supporting member 10 with an appropriate interval Ds.

With respect to a material constituting the conductive layer 211*b* placed around the rotary shaft 211*a*, for example, a rubber material, such as ethylene-propylene-diene-methylene copolymer rubber (EPDM), silicone rubber and urethane rubber, is used, and to such a rubber is dispersed carbon black, such as Ketchen black, acetylene black, and furnace black so that a volume resistivity value is set to not more than $10^6$ Ω·cm; a material obtained in this manner is generally used.

With respect to a material constituting the high resistivity layer 211*d* formed on the surface of the conductive layer 211*b*, a resin material such as nylon and urethane having a volume resistivity value of not less than $10^{10}$ Ω/cm is used, and the layer thickness of the high resistivity layer 211*d* is set in the range of 10 to 150 μm, preferably 50 to 100 μm.

In the present invention, the surface layer 211*d* is designed to have a roughened surface so as to satisfy the relationship:

$$0.6 \leqq (d_{50}/Ra) \leqq 3.0.$$

The roughened surface may be adjusted to a predetermined degree of roughness by addition of fine particles, and the above-mentioned relationship is satisfied by taking into consideration the weight-average particle size of the toner to be loaded into the developing device.

Then, developer (toner) 212 is loaded into a housing section 210*a* of the device main body 210 in the developing device in which the developer-supporting member 211 has been installed, and the developer 212 is fed to the developer-supporting member 211 by rotating feeding blades 213. The developer 212 is held on the surface of the developer-supporting member 211, and the developer 212 is transferred to the developing area facing the image-supporting member 10 by the rotation of the developer-supporting member 211.

On the way of transferring the developer 212 by the developer-supporting member 211 to the developing area facing the image-supporting member 10, a regulating blade 214 installed inside the device 210 is pressed onto the developer-supporting member 211 so that an amount of the developer 212 being transferred by the developer-supporting member 211 is regulated by the regulating blade 214, and that the developer is frictionally charged.

With respect to the regulating blade 214, for example, a plate spring, which has a thickness ranging from 0.08 to 0.2 mm, and is made of stainless steel or phosphorus bronze, is used.

Then, the developer 212, which is frictionally charged by being regulated by the regulating blade 214 as described above, is transferred to the developing area facing the image-supporting member 10 by the developer-supporting member 211. A developing bias voltage with an AC voltage superposed on a DC voltage is applied to the developer-supporting member 211 through a power source 215. In electric field, formed by superposing an alternating electric field onto a DC electric field, is exerted between the conductive base 211*c* and the image-supporting member 10 in the developer-supporting member 211 so that the developer 212 held on the surface of the developer-supporting member 211 is supplied to an electrostatic latent image formed on the image-supporting member 10 so as to develop the image.

In this case, when AC voltage together with the DC voltage from the power source 215 is applied, a value obtained by dividing a peak-to-peak value Vpp of the AC voltage by the distance Ds between the conductive base 211*c* in the developer-supporting member 211 and the image-supporting member 10 facing each other, that is, the intensity of the alternating electric field (Vpp/Ds) exerted between the conductive base 211*c* in the developer-supporting member 211 and the image-supporting member 10, is set in the range of 4 to 9 kV/mm.

In the specific embodiment below, with respect to the developer-supporting member 211, on the conductive base 211*c* formed by placing a conductive layer 211*b* made of EPDM having a volume resistivity value of $10^5$ Ω·cm around the rotary shaft 211*a* made of stainless steel, the high resistance layer 211*d* formed of urethane having a volume resistivity value of $7\times10^{10}$ Ω·cm is installed. The developer-supporting member 211, which has various degrees of Ra roughness with respect to the high resistance layer 211*d* having a layer thickness of 30 μm, is used.

Next, referring to a developing device shown in FIG. 8, an explanation will be given of a mono-component non-contact developing method using magnetic toner.

Figure 8:
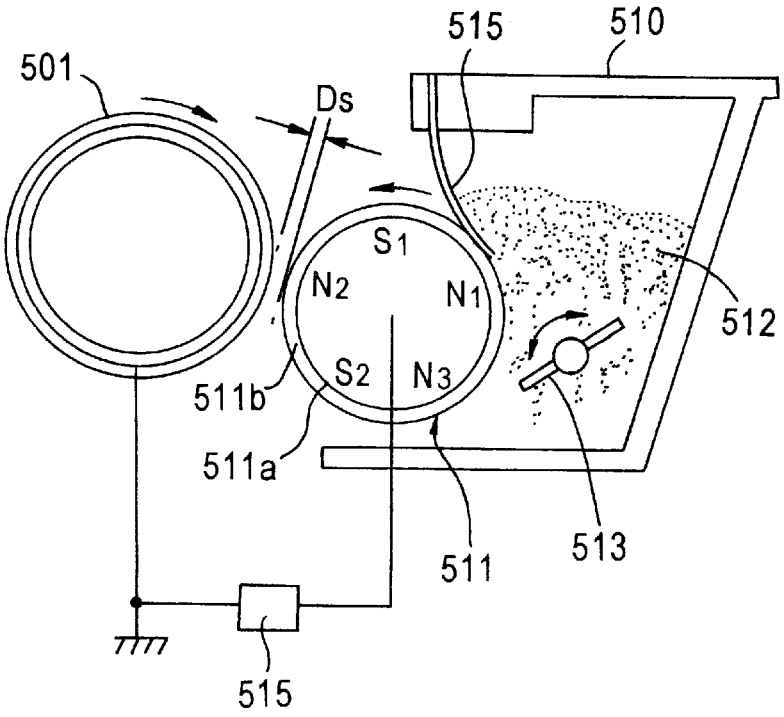
FIG. 8 is a schematic view of structure of mono-component non-contact developing device for magnetic toner.

As illustrated in FIG. 8, a developing sleeve made of an aluminum cylinder in which magnet rollers (511*a*) having a plurality of $N_1$, $S_1$, $N_2$ and $S_2$ are secured to the inner circumference thereof and urethane $R^1$ having a thickness of 30 μm and a volume resistivity of $7\times10^{10}$ Ω·cm is provided on its surface is used as a developer-transferring member (511) for carrying developer. This developing sleeve (511) is supported rotatable so as to face the photosensitive member (501) serving as the image-supporting member at the developing area with an appropriate distance (Ds).

The developer 512 is stored and an agitator 513 is installed on the side opposite to the developing area at which the developer-supporting member 511 and the image-supporting member 501 face each other. The developer 512 stored inside the device body 510 is supplied onto the surface of the developer-supporting member 511 by rotating the agitator 513.

The developer-supporting member 511 is rotated to be provided with the toner on the surface thereof. On the way of transferring the developer 512 held on the surface of the developer-supporting member 511 to the developing area facing the image-supporting member 501, the regulating blade 514 installed inside the device body 510 is pressed onto the surface of the developer-supporting member 511 so that an amount of the developer 512 transferred by the developer-supporting member 511 to the developing area is regulated and that the developer 512 on the surface of the developer-supporting member 511 is frictionally charged.

The frictionally charged developer 512 with is transferred amount regulated by the regulating blade 514 is transferred by the developer-supporting member 511 to the developing area facing the image-supporting member 501 at which the developing bias voltage is applied to the developer-supporting member 511 through the power source 515 so that the developer 512 held on the surface of the developer-supporting member 511 is supplied to an electrostatic latent image formed on the image-supporting member 501. Thus, a developing process is carried out.

In the developing device in which the developer 512 is held on the surface of the developer-supporting member 511 facing the image-supporting member 501 with a predetermined distance, transferred to the developing area facing the image-supporting member and developed with an alternating voltage applied to the developer-supporting member, a peak-to-peak value Vpp of the alternating voltage applied to the developer-supporting member and the distance Ds with which the conductive base in the developer-supporting member and the image-supporting member face each other are set to satisfy the relationship: 4 kV/mm≦Vpp/Ds≦9 kV/mm.

EXAMPLES

Production examples of polyester resins A

To a four-necked flask equipped with a thermometer, a stainless stirring stick, a dropping-type condenser and a nitrogen gas inlet tube were loaded polyoxypropylene(2,2)-2,2-bis(4-hydroxyphenyl)propane (PO), polyoxyethylene(2,0)-2,2-bis(4-hydroxyphenyl)propane (EO) and telephthalic acid (TPA), which were adjusted to a mole ratio of 4:6:9, together with a polymerization initiator (dibutyltinoxide). This flask was put on a mantle heater. The ingredients were heated while being stirred under a nitrogen gas flow to react. The progress of the reaction was followed by measuring its acid value. At the time of reaching a predetermined acid value, the reaction was finished. The contents were cooled to room temperature. Thus, a polyester resin was obtained. The polyester resin obtained was coarsely pulverized into not more than 1 mm, and used in producing toners which will be described later. Polyester resin A thus obtained had a softening point (Tm) of 110.3° C., a glass transition point (Tg) of 68.5° C. an acid value of 3.3 KOHmg/g, a hydroxide value of 28.1 KOHmg/g, a number-average molecular weight (Mn) of 3,300, and a ratio of weight-average molecular weight (Mw)/number-average molecular weight (Mn) of 4.2.

Production examples of polyester resins B and C

Resins B and C were obtained by carrying out the same processes as the production example of polyester resin A, except that the alcohol component and the acid component were changed to have molecular ratios as shown in Table 1. FA represents fumaric acid and TMA represents trimellitic acid.

TABLE 1

| Polyester | Alcohol component | | | Acid component | | | | | Tg | Tm | Acid value | Hydroxide value |
|---|---|---|---|---|---|---|---|---|---|---|---|---|
| resin | PO | EO | GL | FA | TPA | TMA | Mn | Mw/Mn | (° C.) | (° C.) | (KOH mg/g) | (KOH mg/g) |
| A | 4.0 | 6.0 | — | — | 9.0 | — | 3300 | 4.2 | 68.5 | 110.3 | 3.3 | 28.1 |
| B | 5.0 | 5.0 | — | 5.0 | 4.0 | — | 3800 | 3.0 | 68.3 | 102.8 | 3.8 | 28.7 |
| C | 3.0 | 7.0 | — | — | 7.0 | 2.0 | 2800 | 2.3 | 59.5 | 101.8 | 1.3 | 60.4 |

The glass transition point Tg of the resin was measured by a differential scanning calorimeter (DSC-200: made by Seiko Denshi K.K.) in which: based upon alumina as the reference, 10 mg of a sample was measured under the conditions of a temperature-rise rate of 10° C./min and at temperatures ranging from 20 to 160° C. The shoulder value of the main endothermic peak was defined as the glass transition point.

The softening point Tm of resin was measured by Flow Tester (CFT-500; made by Shimadzu Seisakusho K.K). P sample (1 $cm^3$) was fused and flowed under the following conditions; pore of die (diameter 1 mm, length 1 mm), a pressure of 20 $kg/cm^2$ and a temperature-rising rate of 6° C./min. Temperature corresponding to a ½ of the height from the flow-out start point to the flow-out completion point was taken as a softening point.

The number-average molecular weight and the weight-average molecular weight were measured by a gel permeation chromatography (807-IT Type: Nippon Bunko Kogyo K.K.) in which: 10 $kg/cm^3$ of tetrahydrofuran was flowed as a carrier solvent while the column was maintained at 40° C., and 30 mg of a sample to be measured was dissolved in 20 ml of tetrahydrofuran, and then, 0.5 mg of this solution was introduced together with the carrier solvent; thus these molecular weights were measured based upon polystyrene conversion.

Production example of polyester resin D

Into a four-knecked glass flask equipped with a thermometer, a stirrer, a dropping-type condenser and a nitrogen gas inlet pipe were put polyoxypropylene(2,2)-2,2-bis(4-hydroxyphenyl)propane, polyoxyethylene(2,2)-2,2-bis(4-hydroxyphenyl)propane, isododecenyl succinic anhydride, terephthalic acid and fumaric acid so as to be adjusted at a weight ratio of 82:77:16:32:30, together with dibutyl tin oxide as a polymerization initiator. This flask was placed on a mantle heater for heating to react while being stirred at 220° C. under a nitrogen gas atmosphere. A polyester resin D thus obtained had a softening point of 110° C., a glass transition point of 60° C. and an acid value of 17.5 KOH mg/g.

Production example of polyester resin E

Styrene and 2-ethylenehexyl acrylate were adjusted to a weight ratio of 17:3.2, and placed in a dropping funnel together with dicumylperoxide as a polymerization initiator. Into a four-neck glass flask equipped with a thermometer, a stirrer, a dropping-type condenser and a nitrogen gas inlet pipe were put polyoxypropylene(2,2)-2,2-bis(4-hydroxyphenyl)propane, polyoxyethylene(2,2)-2,2-bis(4-hydroxyphenyl)propane, isododecenyl succinic anhydride, terephthalic acid, 1,2,4-benzenetricarboxylic acid anhydride and acrylic acid so as to be adjusted at a height ratio of 42:11:11:11:8:1, together with dibutyl tin oxide as a polymerization initiator. This flask was placed on a mantle heater. The solution was stirred at 135° C. under a nitrogen gas atmosphere, with styrene, etc. being dropped therein from the dropping funnel, and then heated to 230° C. at which reaction was carried out. A polyester resin E thus obtained had a softening point of 150° C., a glass transition point of 62° C. and an acid value of 24.5 KOH mg/g.

Production of toner

Magenta master batch

Polyester resin A 70 parts by weight (Tg: 68.5° C., Tm: 110.3° C.)

Magenta pigment (C.I. Pigment Red 184) 30 parts by weight

A mixture having the above composition was put into a pressure kneader, and mixed and kneaded. After cooled, the resultant kneaded matter was pulverized by a feather mill to give a pigment master batch.

(Toner 1) through (Toner 3)

Polyester resin A 93 parts by weight

Above-mentioned master batch 10 parts by weight

Zinc salicylate complex (E84: Orient Kagaku K.K.)

2 parts by weight

Oxidized-type low molecular polypropylene (Viscol TS-200; Sanyo Kasei Kogyo K.K.)

2 parts by weight

The above materials were sufficiently mixed by Henschel Mixer, and then fused and kneaded by a twin screw extruding kneader (PCM-30; made by Ikegai Tekkou K.K.) whose discharging nozzle had been expanded in its diameter. The resultant kneaded matter was quickly cooled, and coarsely pulverized by a feather mill. The pulverized matter was pulverized and coarsely classified by Jet mill (IDS: made by Nippon Pneumatic K.K.), and then finely classified by DS classifier (made by Nippon Pneumatic K.K.). Thus, toner particles having a weight-average particle size of 7.1 μm was obtained.

To 100 parts by weight of the toner particles were added 0.5 part by weight of hydrophobic silica having a BET specific surface area of 225 $m^2/g$ (TS-500: made by Cabosil K.K.) and 1.0 part by weight of hydrophobic silica (AEROSIL 90G (made by Nippon Aerosil K.K.) treated with hexamethylenedisilazane (BET specific surface area 65 $m^2/g$, pH 6.0 (degree of hydrophobicity; not less than 65%)). This mixture was mixed by Henschel mixer (peripheral speed 40 m/sec, for 60 seconds), and then subjected to a surface-modifying treatment by heat under the following conditions by an instantaneous heating device having a structure as shown in FIG. 1. Thus, toner 1 (weight-average particle size 7.0 μm) was obtained.

Here, in the following Tables 1 and 2, when toner 1 is used in Example 2, it is referred to as toner 2, and when used in Example 3, it is refereed to as toner 3.

(Conditions of surface-modifying treatment)

Developer supplying section; Table feeder+vibration feeder

Dispersing nozzle; Four (Symmetric layout with 90 degrees respectively to all circumference)

Ejecting angle; 30 degrees

Amount of hot air; 800 L/min

Amount of dispersing air; 55 L/min

Amount of suction air; −1200 L/min

Dispersion density; 100 $g/m^3$

Processing temperature; 250° C.

Residence time; 0.5 second

Temperature of cooling air; 15° C.

Temperature of cooling water; 10° C.

Toners 4 through 7

The same manufacturing method as toner 1 was carried out except that fine particle classifying conditions were changed in the manufacturing method of toner 1 so as to change the weight-average particle size of the toner particle. Thus, toners 4 through 7 were obtained.

Toner 4: weight-average particle size 9.0 μm

Toner 5: weight-average particle size 5.1 μm

Toner 6: weight-average particle size 8.8 μm

Toner 7: weight-average particle size 6.0 μm

Toners 8 and 9

The same method and compositions as those of production example of toner 1 were used except that the weight-average particle size was changed to 7.1μm and processing temperatures were changed to 200° C. and 300° C. Thus, toners 8 and 9 were obtained.

Toner 10

The same method and compositions as those of toner 1 were used except that the amount of polyester resin A was changed to 100 parts by weight and that the pigment master batch was changed to 4 parts by weight of carbon black (Mogul L; made by Cabot K.K.). Thus, toner 10 was obtained.

Toner 11 (Oil-less fixing black toner)

Polyester resin D(40 parts by weight), 60 parts by weight of polyester resin E, 2 parts by weight of polyethylene wax (800P; made by Mitsui Sekiyu Kagaku K.K.; melt viscosity 5,400 cps at 160° C.; softening point 140° C.), 2 parts by weight of polypropylene wax (TS-200; made by Mitsui Kasei Kogyo K.K.; melt viscosity 120 cps at 160° C; softening point 145° C.; acid value 3.5 KOHmg/g), 8 parts by weight of acid carbon black (Mogul-L; made by Cabot K.K.; pH 2.5; average primary particle size 24 nm) and 2 parts by weight of a negative charge-control agent represented by the following formula were sufficiently mixed by Henschel mixer, melt and kneaded by a twin screw extruding kneader.

(A)

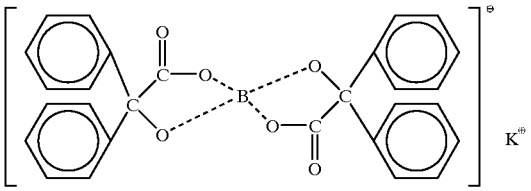

This kneaded material was cooled off, coarsely pulverized by a hammer mill, and finely pulverized by a jet mill, and then classified. Thus, toner particles having a weight-average particle size of 7.1 μm was obtained.

The same method as example of production for toner 1 was carried out except that the amount of fluidizing agent prior to the heat treatment was changed to 0.6 part by weight of hydrophobic silica (TS-500: made by Cabosil K.K.) and 1.2 parts by weight of hydrophobic silica (AEROSIL 90G (made by Nippon Aerosil K.K.) treated with hexamethylenedisilazane (BET specific surface area 6;5 $m^2/g$, pH 6.0, degree of hydrophobicity not less than 65%), and that with respect to the surface-modifying conditions, the processing temperature was changed to 270° C. Thus, toner 11 (weight-average particle size 7.2 μm) was obtained.

Toner 12

The same compositions as production method for toner 1 were used except that the ratio of mixture of polyester resin B and resin C was changed to 20:80. Thus, toner 12 (weight-average particle size 7.2 μm) was obtained.

Toner 13

The same compositions as production method for toner 12 were used except that the amounts of polyester resin B and polyester resin C were respectively changed to 20 parts by weight and 80 parts by weight and that the pigment master batch was changed to 4 parts by weight of carbon black (Mogul-L; made by Cabot K.K.). Thus, toner 13 (weight-average particle size 7.2 μm) was obtained.

Toner 14 (hereinafter, toners for comparative examples)

By changing the fine particle classifying conditions in production method of toner 1, toner particles having a weight-average particle size of 7.1 μm were obtained.

To 100 parts by weight of the toner particles was added 1.0 part by weight of hydrophobic silica (RX200: made by Nippon Aerosil K.K.; BET specific surface area 140 $m^2/g$, pH 7.0). This mixture was subjected to a surface-modifying treatment by heat under the following conditions. Thus, toner particles 14 having a weight-average particle size of 8.4 μm was obtained.

(Conditions of surface-modifying treatment)

Developer supplying section; Table feeder

Dispersing nozzle; Two (Symmetric layout with respect to all circumference)

Ejecting angle; 45 degrees

Amount of hot air; 620 L/min

Amount of dispersing air; 68 L/min

Amount of suction air; −900 L/min

Dispersion density; 150 $g/m^3$

Processing temperature; 300° C.

Residence time; 0.5 second

Temperature of cooling air; 30° C.

Temperature of cooling water; 20° C.

Toner 15

The same method and compositions as production example of toner 9 were carried out except that the processing temperature was changed to 150° C. (weight average particle size 7.1 μm). Thus, toner 15 was obtained.

Toner 16 To 100 parts by weight of polyester resin A were added 15 parts by weight of magenta pigment (C.I. Pigment: Red 184), 1 part by weight of a boron compound represented by the following formula and 400 parts by weight of toluene. This mixture was dissolved and dispersed by mixing in an ultrasonic homogenizer (output 400 μA) for 30 minutes, thereby preparing a colored resin solution.

Separately, to 1,000 parts by weight of an aqueous solution containing 4% by weight of calcium phosphate hydroxide serving as a dispersion stabilizer was dissolved 0.1 part by weight of lauryl sodium sulfate (made by Wako Jyunyaku K.K.) so that an aqueous dispersion solution was prepared. To 100 parts by weight of this aqueous dispersion solution was dropped 50 parts by weight of the above-mentioned colored resin solution while being stirred at 4,000 rpm by TK Auto Homo Mixer (made by Tokushu Kika Kogyo K.K.), with the result that droplets of the colored resin solution were suspended in the aqueous dispersion solution. This suspended liquid was left for 5 hours under the conditions of 60° C. and 100 mmHg so that toluene was removed from the droplet and colored resin particles were crystallized. Then, calcium phosphate hydroxide was dissolved therefrom by using concentrated sulfuric acid. The obtained solution was subjected to repeated filtration/washing processes. The filtrated matter was dried at 80° C. by using a slurry drying device (Dispacoat; made by Nisshin Engineering K.K.). Thus, magenta toner 16 (weight-average particle size: 7.2 μm) was obtained.

Toner 17

The particles of toner 1 prior to the heating treatment were used as toner 17.

Toner 18

The same processes as production of toner 13 were carried out except that the heating treatment condition was changed to 250° C., thereby obtaining toner 18 having a weight-average particle size of 7.9 μm.

Toner 19 Styrene (60 parts by weight), 35 parts by weight of n-butylmethacrylate, 5 parts by weight of methacrylate, 0.5 part by weight of 2,2-azobis(2,4-dimethylvaleronitrile), 3 parts by weight of low molecular polypropylene (Viscol 660P; made by Sanyo Kasei kogyo K.K.), 8 parts by weight of carbon black (MA#8; made by Mitsubishi Kagaku K.K.) and chrome complex (Aizen Spilon black TRH; made by Hodogaya Kagaku K.K.) were sufficiently mixed by a sand stirrer, thereby preparing a polymerization composition. This polymerization composition was allowed to react for six hours at 60° C. while being stirred at 4,000 rpm by 7K Auto Homo Mixer (made by Tokushukika Kogyo K.K.) in an aqueous solution of arabic rubber having a concentration of 3% by weight. Thus, spherical particles having an average particle size of 6.8 μm were obtained. The spherical particles were subjected to filtration/washing processes three times. The filtrated product was then dried by air under the conditions of 35° C. and 30% RH. Thus, toner 19 was obtained.

With respect to toners 1 through 17, the following factors were measured and the results are listed in Table 2: toner weight-average particle size ($d_{50}$) (μm), ratio of content of particles having sizes not less than two times the weight-average particle size (>$2d_{50}$ (wt %)), ratio of content of particles having sizes not more than ⅓ the weight-average particle size (<⅓$d_{50}$ (pop %)), degree of roundness (average degree of roundness), standard deviation of the degree of roundness (SD), and toner surface characteristics ($D/d_{50}$)

TABLE 2

| | Toner | $d_{50}$ (μm) | >$2d_{50}$ (wt %) | <⅓$d_{50}$ (pop %) | Degree of roundness | SD value | $D/d_{50}$ | $d_{50}$/Ra |
|---|---|---|---|---|---|---|---|---|
| Example 1 | Toner 1 | 7.0 | 0.1 | 2.8 | 0.981 | 0.026 | 0.54 | 1.40 |
| Example 2 | Toner 2 | 7.0 | 0.1 | 2.8 | 0.981 | 0.026 | 0.54 | 2.50 |
| Example 3 | Toner 3 | 7.0 | 0.1 | 2.8 | 0.981 | 0.026 | 0.54 | 0.70 |
| Example 4 | Toner 4 | 9.0 | 0.1 | 2.8 | 0.98 | 0.025 | 0.52 | 2.40 |
| Example 5 | Toner 5 | 5.1 | 0.1 | 2.8 | 0.986 | 0.028 | 0.55 | 2.30 |
| Example 6 | Toner 6 | 8.8 | 0.1 | 2.8 | 0.98 | 0.025 | 0.52 | 0.71 |
| Example 7 | Toner 7 | 6.0 | 0.1 | 2.8 | 0.984 | 0.027 | 0.55 | 0.71 |
| Example 8 | Toner 8 | 7.1 | 0.1 | 2.9 | 0.961 | 0.034 | 0.52 | 1.48 |
| Example 9 | Toner 9 | 7.1 | 0.1 | 2.7 | 0.99 | 0.018 | 0.57 | 1.40 |
| Example 10 | Toner 10 | 7.0 | 0.1 | 3.0 | 0.983 | 0.026 | 0.54 | 1.40 |
| Example 11 | Toner 11 | 7.2 | 0.1 | 4.1 | 0.98 | 0.03 | 0.53 | 1.60 |
| Example 12 | Toner 12 | 7.2 | 0.1 | 2.6 | 0.980 | 0.028 | 0.53 | 1.40 |
| Example 13 | Toner 13 | 7.2 | 0.1 | 2.6 | 0.980 | 0.028 | 0.53 | 1.40 |
| Comparative Example 1 | Toner 14 | 8.4 | 1.6 | 2.8 | 0.972 | 0.046 | 0.54 | 1.40 |
| Comparative Example 2 | Toner 15 | 7.1 | 0.2 | 3.2 | 0.943 | 0.038 | 0.35 | 1.40 |
| Comparative Example 3 | Toner 16 | 7.2 | 0.3 | 4.1 | 0.98 | 0.034 | 0.35 | 1.60 |
| Comparative Example 4 | Toner 17 | 7.1 | 0.1 | 3.2 | 0.943 | 0.039 | 0.36 | 1.40 |
| Comparative Example 5 | Toner 4 | 9.0 | 0.1 | 2.8 | 0.98 | 0.025 | 0.52 | 0.50 |
| Comparative Example 6 | Toner 5 | 5.1 | 0.1 | 2.8 | 0.986 | 0.028 | 0.55 | 3.05 |
| Comparative Example 7 | Toner 18 | 7.9 | 0.9 | 2.6 | 0.974 | 0.041 | 0.50 | 1.40 |
| Comparative Example 8 | Toner 19 | 6.8 | 0.4 | 4.4 | 0.988 | 0.036 | 0.36 | 1.40 |

The average particle size and its distribution were measured by Coulter Multisizer (made by Coulter Counter K.K.) with an aperture tube diameter of 50 μm.

With respect to the average degree of roundness and the SD value, measurements were made by a flow-type particle image analyzer (EPIA-1000; made by Toa Iyoudenshi K.K.).

With respect to S (BET specific surface area) required for calculating $D/d_{50}$, measurements were made by Flow Sorb 2,300 (made by Simazu Seisakusho K.K.).

To 100 parts by weight of each of the toners we(re added 0.5 part of hydrophobic silica R972 (made by Nippon Aerosil K.K.) having a BET specific surface area of 110 $m^2/g$ and 0.3 part of strontium titanate particles having a BET specific surface area of 9 $m^2/g$. The mixture was mixed by Henschel Mixer at 30 m/sec for 180 seconds. Then, the resultant mixture was sieved by a round sieve shaker (having meshes of 77 μm).

With respect to an apparatus for carrying out evaluation, a full color printer Color PagePro TM PS (made by Minolta K.K) (modified), which has a structure as shown in FIG. 3 and is provided with the developing device having the structure as shown in FIG. 4, was used.

Printer conditions:

Developing bias: −300 V

System speed: 140 mm/sec $d_{50}$/Ra (shown in Table 2)

The toners, prepared as described above, were -out into the evaluation apparatus. Magenta images were duplicated in mono-color copy. Evaluation was made as follows on the transferring properties, amount of small-particle components on the sleeve, fog on the photosensitive member (P/C fog), sleeve filming and charging stability. The evaluation was ranked as follows. The results are shown in Table 3.

(Transferring properties)

With respect to transferring properties, evaluation was made based on excessive transfer or insufficient transfer.

With respective to excessive transfer (poor in electrical charging), after 10 copies was made on B/W 0% (white), a copied image was checked for fog, and ranked as follows. B/W represents image portion/non-image portion.

○: No fog.

Δ: Fog slightly observed; however, no problem arose in practical use.

×: Fog observed.

With respect to insufficient transfer, after 5 to 10 copies was made on B/W 30%, a copied image of B/W 100% was checked for the density, and ranked as follows:

○: No density irregularity;

Δ: Density irregularity slightly observed; however, no problem arose in practical use;

×: Density irregularity observed.

(Sleeve filming)

Sleeve filming is a surface layer of toner particle components formed on the surface of the sleeve due to fused and adhered toner particles, etc. After 5,000 copies of B/W 5% image was made, copied images were checked, and ranked as follows:

○: No filming observed;

Δ: Filming slightly observed; however, no problem arose in practical use;

×: Filming observed remarkably.

(Amount of small-particle components on the sleeve)

A ratio (number %) of toner particles having particle size of 5 Em or less that occupy the toner thin layer formed on the sleeve was measured. More specifically, after 3,000 copies of B/W 5% image was made, a toner thin layer formed on the sleeve was sucked, and the sucked toner sample was measured on the particle size distribution based on the number. Then, a content of the number of toner particles having particle sizes not more than 5 μm was confirmed, and ranked as follows:

○: Not more than 25%;

Δ: 25 to 35%;

×: Not less than 35%.

(Fogs on the photosensitive member)

Toner was set in the developing device in the imaging cartridge, and this developing device was attached to the printer. Then, after 5 to 10 copies of B/W 5% was made (initial), one sheet was fed in the white developing mode (white paper mode) and the copying process was suspended in the middle of the process. This was also carried out after 10 K of copies was made.

After the suspension, the imaging cartridge was taken out of the printer and fog on the photosensitive member was observed.

○: No fog observed.

Δ: Fog slightly observed; however, no problem arose in practical use.

×: Fog observed.

(Charging stability)

A character pattern having a B/W ratio of 5% was copied. At initial stage and after copies of 5K had been made, one sheet was fed in the white developing mode (white paper mode). A quantity of charging was measured by an sucking method of toner on the sleeve, and ranked based on the difference therebetween.

The absolute value of the difference in the Quantities of charge between the initial copying stage and 5 K copied stage. Thus, a value not more than 5 μC/g is ranked as ○, and the value greater than this is ranked as ×.

TABLE 3

| | Toner | transfer properties | Small-size components on sleeve | P/C Fog Initial | P/C Fog 10K | Sleeve filming | Charging stability |
|---|---|---|---|---|---|---|---|
| Example 1 | Toner 1 | ○ | ○ | ○ | ○ | ○ | ○ |
| Example 2 | Toner 2 | ○ | ○ | ○ | ○ | ○ | ○ |
| Example 3 | Toner 3 | ○ | ○ | ○ | ○ | ○ | ○ |
| Example 4 | Toner 4 | ○ | ○ | ○ | ○ | ○ | ○ |
| Example 5 | Toner 5 | ○ | ○ | ○ | ○ | ○ | ○ |
| Example 6 | Toner 6 | ○ | ○ | ○ | ○ | ○ | ○ |
| Example 7 | Toner 7 | ○ | ○ | ○ | ○ | ○ | ○ |
| Example 8 | Toner 8 | ○ | ○ | ○ | ○ | ○ | ○ |
| Example 9 | Toner 9 | ○ | ○ | ○ | ○ | ○ | ○ |
| Example 10 | Toner 10 | ○ | ○ | ○ | ○ | ○ | ○ |
| Example 11 | Toner 11 | ○ | ○ | ○ | ○ | ○ | ○ |
| Example 12 | Toner 12 | ○ | ○ | ○ | ○ | ○ | ○ |
| Example 13 | Toner 13 | ○ | ○ | ○ | ○ | ○ | ○ |
| Comparative Example 1 | Toner 14 | ○ | × | ○ | × | × | × |
| Comparative Example 2 | Toner 15 | ○ | × | ○ | × | × | × |
| Comparative Example 3 | Toner 16 | ○ | × | ○ | × | × | × |
| Comparative Example 4 | Toner 17 | ○ | × | ○ | × | × | × |
| Comparative Example 5 | Toner 4 | ×*1) | × | × | × | × | × |
| Comparative Example 6 | Toner 5 | ×*2) | × | ○ | × | × | × |
| Comparative Example 7 | Toner 18 | ○ | × | ○ | × | × | × |
| Comparative Example 8 | Toner 19 | ○ | × | ○ | × | × | |

*1) With excessive transfer, fog observed

*2) With poor transfer, density irregularity observed.

With respect to an evaluation apparatus, a full-color printer (Color Page Pro TM PS: made by Minolta K.K.), which had a modified developing device having a construction as shown in FIG. 7, was used, and evaluation was made under the following setting conditions:

Printer conditions

System speed: 200 mm/sec

DC bias: −450 V

Vibration electric field (Vp-p/Ds): 7.5 KV/mm $d_{50}$/Ra and Ds are shown in Table 4.

The toners, prepared as described above, were loaded into the evaluation apparatus, and evaluations on the transferring properties, amount of small-particle components on the sleeve, fog on the photosensitive member (P/C fog), moving properties, sleeve filming, charging stability and texture were made as follows. The results are ranked as shown in Table 5.

TABLE 4

| | Toner | $d_{50}$ ($\mu$m) | $2d_{50}$ (wt %) | $<\frac{1}{3}d_{50}$ (pop %) | Degree of roundness | SD value | $D/d_{50}$ | $d_{50}/Ra$ | Ds (mm) |
|---|---|---|---|---|---|---|---|---|---|
| Example 14 | Toner 1 | 7.0 | 0.1 | 2.8 | 0.981 | 0.026 | 0.54 | 1.40 | 0.25 |
| Example 15 | Toner 2 | 7.0 | 0.1 | 2.8 | 0.981 | 0.026 | 0.54 | 2.50 | 0.25 |
| Example 16 | Toner 3 | 7.0 | 0.1 | 2.8 | 0.981 | 0.026 | 0.54 | 0.70 | 0.25 |
| Example 17 | Toner 4 | 9.0 | 0.1 | 2.8 | 0.98 | 0.025 | 0.52 | 2.40 | 0.25 |
| Example 18 | Toner 5 | 5.1 | 0.1 | 2.8 | 0.986 | 0.028 | 0.55 | 2.30 | 0.25 |
| Example 19 | Toner 6 | 8.8 | 0.1 | 2.8 | 0.98 | 0.025 | 0.52 | 0.71 | 0.25 |
| Example 20 | Toner 7 | 6.0 | 0.1 | 2.8 | 0.984 | 0.027 | 0.55 | 0.71 | 0.25 |
| Example 21 | Toner 8 | 7.1 | 0.1 | 2.9 | 0.961 | 0.034 | 0.52 | 1.48 | 0.25 |
| Example 22 | Toner 9 | 7.1 | 0.1 | 2.7 | 0.99 | 0.018 | 0.57 | 1.40 | 0.25 |
| Example 23 | Toner 10 | 7.0 | 0.1 | 3.0 | 0.983 | 0.026 | 0.54 | 1.40 | 0.25 |
| Example 24 | Toner 11 | 7.2 | 0.1 | 4.1 | 0.98 | 0.03 | 0.53 | 1.60 | 0.25 |
| Example 25 | Toner 1 | 7.0 | 0.1 | 2.8 | 0.981 | 0.026 | 0.54 | 1.40 | 0.40 |
| Example 26 | Toner 9 | 7.1 | 0.1 | 2.7 | 0.99 | 0.018 | 0.57 | 1.40 | 0.40 |
| Example 27 | Toner 12 | 7.2 | 0.1 | 2.6 | 0.980 | 0.028 | 0.53 | 1.40 | 0.25 |
| Example 28 | Toner 13 | 7.2 | 0.1 | 2.6 | 0.980 | 0.028 | 0.53 | 1.40 | 0.25 |
| Comparative Example 9 | Toner 14 | 8.4 | 1.6 | 2.8 | 0.972 | 0.046 | 0.54 | 1.40 | 0.25 |
| Comparative Example 10 | Toner 15 | 7.1 | 0.2 | 3.2 | 0.943 | 0.038 | 0.35 | 1.40 | 0.25 |
| Comparative Example 11 | Toner 16 | 7.2 | 0.3 | 4.1 | 0.98 | 0.034 | 0.35 | 1.60 | 0.25 |
| Comparative Example 12 | Toner 17 | 7.1 | 0.1 | 3.2 | 0.943 | 0.039 | 0.36 | 1.40 | 0.25 |
| Comparative Example 13 | Toner 4 | 9.0 | 0.1 | 2.8 | 0.98 | 0.025 | 0.52 | 0.50 | 0.25 |
| Comparative Example 14 | Toner 5 | 5.1 | 0.1 | 2.8 | 0.986 | 0.028 | 0.55 | 3.1 | 0.25 |
| Comparative Example 15 | Toner 18 | 7.9 | 0.9 | 2.6 | 0.974 | 0.041 | 0.50 | 1.40 | 0.25 |
| Comparative Example 16 | Toner 19 | 6.8 | 0.4 | 4.4 | 0.988 | 0.036 | 0.36 | 1.40 | 0.25 |

TABLE 5

| | Toner | transfer properties | Small-size components on sleeve | P/C Fog Initial | P/C Fog 10K | Moving properties | Sleeve filming | Charging stability | Texture |
|---|---|---|---|---|---|---|---|---|---|
| Example 14 | Toner 1 | ○ | ○ | ○ | ○ | ○ | ○ | ○ | ○ |
| Example 15 | Toner 2 | ○ | ○ | ○ | ○ | ○ | ○ | ○ | ○ |
| Example 16 | Toner 3 | ○ | ○ | ○ | ○ | ○ | ○ | ○ | ○ |
| Example 17 | Toner 4 | ○ | ○ | ○ | ○ | ○ | ○ | ○ | ○ |
| Example 18 | Toner 5 | ○ | ○ | ○ | ○ | ○ | ○ | ○ | ○ |
| Example 19 | Toner 6 | ○ | ○ | ○ | ○ | ○ | ○ | ○ | ○ |
| Example 20 | Toner 7 | ○ | ○ | ○ | ○ | ○ | ○ | ○ | ○ |
| Example 21 | Toner 8 | ○ | ○ | ○ | ○ | ○ | ○ | ○ | ○ |
| Example 22 | Toner 9 | ○ | ○ | ○ | ○ | ◎ | ○ | ○ | ○ |
| Example 23 | Toner 10 | ○ | ○ | ○ | ○ | ○ | ○ | ○ | ○ |
| Example 24 | Toner 11 | ○ | ○ | ○ | ○ | ○ | ○ | ○ | ○ |
| Example 25 | Toner 1 | ○ | ○ | ○ | ○ | ○ | ○ | ○ | ○ |
| Example 26 | Toner 9 | ○ | ○ | ○ | ○ | ◎ | ○ | ○ | ○ |
| Example 27 | Toner 12 | ○ | ○ | ○ | ○ | ○ | ○ | ○ | ○ |
| Example 28 | Toner 13 | ○ | ○ | ○ | ○ | ○ | ○ | ○ | ○ |
| Comparative Example 9 | Toner 14 | ○ | × | ○ | × | × | × | × | × |
| Comparative Example 10 | Toner 15 | ○ | × | ○ | × | × | × | × | × |
| Comparative Example 11 | Toner 16 | ○ | × | ○ | × | × | × | × | × |
| Comparative Example 12 | Toner 17 | ○ | × | ○ | × | × | × | × | × |
| Comparative Example 13 | Toner 4 | × | × | × | × | × | × | × | × |
| Comparative Example 14 | Toner 5 | × | × | ○ | × | × | × | × | × |
| Comparative Example 15 | Toner 18 | ○ | × | ○ | × | × | × | × | × |
| Comparative Example 16 | Toner 19 | ○ | × | ○ | × | × | × | × | × |

(Transfer properties)

With respect to the transferring properties, the same evaluation as that of example 1 was made.

(Moving properties)

After 5 to 10 copies of B/W 5% image were made, developing bias voltages varied in several steps from low bias to high bias were applied separately when an image-pattern having a solid image of ϕ5 was copied. The copying process was suspended in the middle of the process. Then, an amount of adhesion on the PC (photosensitive member) was measured, and ranked as follows:

◎: Amount of adhesion on PC: extremely good level;

○: Amount of adhesion on PC: proper level;

Δ: Amount of adhesion on PC: level in which no problem arises in practical use;

×: Amount of adhesion on PC: small.

(Sleeve filming)

Sleeve filming is a surface layer of toner particle components formed on the surface of the sleeve due to fused and adhered toner particles, etc. After 10,000 copies of C/W 5% image were made, the sleeve was observed, and ranked as follows:

○: No filming observed.

Δ: Filming slightly observed; however, no problem arose in practical use.

×: Filming observed remarkably.

(Amount of small-particle components on the sleeve)

The same evaluation as example 1 was carried out.

(Fog on photosensitive member)

The same evaluation as example 1 was carried out.

(Charging stability)

A character pattern having a B/W ratio of 5% was copied. At initial stage of copy and after 10K copies were made, one sheet was fed in the white developing mode (white paper mode). A quantity of charging was measured by a sucking method of toner on the sleeve, and ranked based on the difference therebetweeen.

An absolute value of the difference in the quantities of charge between the initial stage and the stage after 10K copies were made was obtained. The value not more than 5 $\mu$C/g is ranked as ○. The value greater than this is ranked as ×.

(Texture of image)

Half-tone images were observed, and ranked as follows:

○: Fine texture was obtained.

Δ: Rough texture was slightly observed; however, no problem arose in practical use.

×: Rough texture was observed remarkably.

(Preparation of toner (magnetic black toner))

(1) Preparation of toner 20

Polyester resin D (L-type)(40 parts by weight), 60 parts by weight of polyester resin E (H-type), 2 parts by weight of polyethylene wax (80OP; made by Mitsui Sekiyu Kagaku K.K.; melt viscosity 5,400 cps at 160° C.; softening point 140° C.), 2 parts by weight of polypropylene wax (TS-200; made by Sanyo Kasei Kogyo K.K.; melt viscosity 120 cps at 160° C.; softening point 145° C; acid value 3.5 KOHmg/g), 50 parts by weight of magnetic particles (Magnetite; EPT- 1,000: made by Toda Kogyo K.K.) and 2 parts by weight of chrome complex serving as a negative charge-control agent (Aizen Spilon black TRH; made by Hodogaya Kagaku K.K.) were sufficiently mixed by Henschel mixer, and melt and kneaded by a twin screw extruding kneader. Then, the kneaded material was cooled off, coarsely pulverized by a hammer mill, and finely pulverized by a jet mill, and then classified. Thus, toner particles A having a weight-average particle size of 7.0 $\mu$m was obtained.

To 100 parts by weight of the toner particles were added 0.6 part by weight of hydrophobic silica having a BET specific surface area of 225 $m^2/g$ (TS-500: made by Cabosil K.K.) and 1.2 part by weight of hydrophobic silica (AEROSIL 90G (made by Nippon Aerosil K.K.) treated with hexamethylenedisilazane; BET specific surface area 65 $m^2/g$, pH 6.0 (degree of hydrophobicity; not less than 65%)) The resultant mixture was mixed by Henschel mixer (peripheral speed 40 m/sec, for 60 seconds), and then subjected to a heating treatment at 300° C. under the following conditions by a device having a structure as shown in FIG. 3. Thus, toner particles 20 having a weight-average particle size 7.1 $\mu$m were obtained.

(Conditions of surface-modifying treatment)

Developer supplying section; Table feeder +vibration feeder

Dispersing nozzle; Four (Symmetric layout with 90 degrees respectively to all circumference)

Ejecting angle; 30 degrees

Amount of hot air; 800 L/min

Amount of dispersing air; 55 L/min

Amount of suction air; −1200 L/min

Dispersion density; 100 $g/m^3$ Processing temperature; 300° C.

Residence time; 0.5 second

Temperature of cooling air; 15° C.

Temperature of cooling water; 10° C.

When toner 20 is used in Example 30, it is referred to as toner 21. When used in Example 31, it is referred to as toner 22.

(2) Preparation of toner 23

The same fluidizing treatment and surface-modifying treatment as those of toner 20 were carried out except that the classified weight-average particle size prior to the surface-modifying treatment was set to 9.0 $\mu$m, thereby obtaining toner 23.

(3) Preparation of toner 24

The same fluidizing treatment and surface-modifying treatment as those of toner 20 were carried out except that the classified weight-average particle size prior to the surface-modifying treatment was set to 5.1 $\mu$m, thereby obtaining toner 24.

(4) Preparation of toner 25

The same fluidizing treatment and surface-modifying treatment as those of toner 20 were carried out except that the classified weight-average particle size prior to the surface-modifying treatment was set to 8.8 $\mu$m, thereby obtaining toner 25.

(5) Preparation of toner 26

The same fluidizing treatment and surface-modifying treatment as those of toner 20 were carried out except that the classified weight-average particle size prior to the surface-modifying treatment was set to 6.0 $\mu$m, thereby obtaining toner 26.

(6) Preparation of toner 27

The same fluidizing treatment and surface-modifying treatment as those of toner 20 were carried out except that the temperature of the heating process for the surface-modifying treatment was changed to 250° C., thereby obtaining toner 27 (weight-average particle size 7.2 $\mu$m).

(7) Preparation of toner 28

The same fluidizing treatment and surface-modifying treatment as those of toner 20 were carried out except that the temperature of the heating process for the surface-modifying treatment was changed to 350° C., thereby obtaining toner 28 (weight-average particle size 7.3 $\mu$m).

(8) Preparation of toner 29

To 100 parts by weight of the toner particles A obtained by preparation of toner 20 was added 1.0 part by weight of hydrophobic silica (RX-200: made by Nippon Aerosil K.K.; BET specific surface area 140 $m^2/g$, pH 7.0). This mixture was subjected to a mixing process (peripheral velocity 40 m/sec, for 180 seconds) by Henschel Mixer, and then subjected to a surface-modifying treatment by heat under the following conditions by using the device shown in FIG. 1. Thus, toner particles 29 (weight-average particle size of 7.8 $\mu$m) were obtained.

(Conditions of surface-modifying treatment)

Developer supplying section; Table feeder

Dispersing nozzle; Two (Symmetric layout with respect to all circumference)

Ejecting angle; 45 degrees

Amount of hot air; 620 L/min

Amount of dispersing air; 68 L/min

Amount of suction air; −900 L/min

Dispersion density; 150 $g/m^3$

Processing temperature; 300° C.

Residence time; 0.5 second

Temperature of cooling air; 30° C.

Temperature of cooling water; 20° C.

(9) Preparation of toner 30

The same fluidizing treatment and surface-modifying treatment as those of toner 29 were carried out except that the temperature of the heating process for the surface-modifying treatment was changed to 170° C., thereby obtaining toner 30 (weight-average particle size 7.3 $\mu$m).

(10) Preparation of toner 31

Styrene (60 parts by weight), 35 parts by weight of n-butylmethacrylate, 5 parts by weight of methacrylate, 0.5 part by weight of 2,2-azobis(2,4-dimethylvaleronitrile), 3 parts by weight of low molecular polypropylene (Viscol 660P; made by Sanyo Kasei kogyo K.K.), 35 parts by weight of magnetic particles (ferrite particles; MFP-2 made by TDK K.K.) and chrome complex (Aizen Spilon black TRH; made by Hodogaya Kagaku K.K.) were sufficiently mixed by a sand stirrer to give a polymerization composition. This polymerization composition was allowed to react for six hours at 60° C. while being stirred at 5,000 rpm by TK Auto Homo Mixer (made by Tokushukika Kogyo K.K.) in an aqueous solution of arabic rubber having a concentration of 3% by weight. Thus, spherical particles having an average particle size of 6.8 $\mu$m were obtained. The spherical particles were subjected to filtration/washing processes three times. The filtrated product was then dried by air under the conditions of 35° C. and 30% RH to give toner 31.

(11) Preparation of toner 32

The toner particles A obtained by preparation of toner 20 were used as toner 32.

To 100 parts by weight of each of the toner particles were added 0.5 part by weight of hydrophobic silica R972 (made by Nippon Aerosil K.K.) having a BET specific surface area of 110 $m^2/g$ and 0.3 part by weight of strontium titanate particles having a BET specific surface area of 9 $m^2/g$, and this was mixed by Henschel Mixer at 30 n/sec for 180 seconds. Then, this was sieved by using a round sieve shaker (having meshes of 77 $\mu$m).

With respect to toners 20 through 32 thus obtained, weight-average particle size $d_{50}$, $>2d_{50}$ (wt %), $<\frac{1}{3}d_{50}$ (pop %), degree of roundness, SD value and $D/d_{50}$, are shown in Table 6.

TABLE 6

| | Toner characteristics | | | | | |
|---|---|---|---|---|---|---|
| | $d_{50}$ ($\mu$m) | $>2d_{50}$ (wt %) | $<\frac{1}{3}d_{50}$ (pop %) | Degree of roundness | SD value | $D/d_{50}$ |
| Toner 20 | 7.1 | 0.1 | 3.8 | 0.976 | 0.035 | 0.46 |
| Toner 23 | 9.0 | 0.1 | 3.8 | 0.974 | 0.036 | 0.29 |
| Toner 24 | 5.1 | 0.1 | 3.8 | 0.98 | 0.034 | 0.34 |
| Toner 25 | 8.8 | 0.1 | 3.8 | 0.974 | 0.036 | 0.29 |
| Toner 26 | 6.0 | 0.1 | 3.8 | 0.978 | 0.034 | 0.33 |
| Toner 27 | 7.2 | 0.1 | 3.8 | 0.955 | 0.039 | 0.26 |
| Toner 28 | 7.3 | 0.1 | 2.8 | 0.986 | 0.029 | 0.37 |
| Toner 29 | 7.8 | 1.7 | 3.6 | 0.939 | 0.049 | 0.27 |
| Toner 30 | 7.3 | 0.2 | 4.4 | 0.936 | 0.05 | 0.16 |
| Toner 31 | 6.8 | 0.5 | 4.2 | 0.986 | 0.038 | 0.17 |
| Toner 32 | 7.0 | 0.1 | 4.6 | 0.934 | 0.045 | 0.15 |

Here, "$>2d_{50}$ (wt %)" represents a ratio of content of those particles having particle sizes not less than two 5 times the weight-average particle size, and "$<\frac{1}{3}d_{50}$ (pop %)" represents a ratio of content of those particles having particles sizes not more than ⅓ the weight-average particle size.

EXAMPLES 29 through 39

Using the magnetic toners shown in FIG. 7, the surface roughness of the developer-transferring and supporting member was adjusted so as to have the ratio $d_{50}$/Ra shown in Table 7, and non-contact mono-component developing tests were carried out. The developing processes were carried out by using a developing device shown in FIG. 8 (a modified Di33 (made by Minolta K.K.) corresponding to System 300mm/sec)(DC developing bias: −450 V, $V_{p-p}$/Ds: 7 KV/mm).

With respect to the developing states of the respective examples, evaluation on transferring properties, amount of small-particle components on the sleeve, initial fog on P/C (photosensitive member) fog, moving properties, sleeve filming, charging stability and texture was made as follows, and the results are ranked as shown in Table 7.

COMPARATIVE EXAMPLES 17 THROUGH 22

Using the magnetic toners shown in Table 7, mono-component developing tests were carried out in the same manner as Examples at a ratio of $d_{50}$/Ra shown in Table 7. The results of the developing tests are shown in Table 7 together with Examples.

TABLE 7

| | Toner No. | $d_{50}$/Ra | Results of developing | | | | | | |
|---|---|---|---|---|---|---|---|---|---|
| | | | transfer properties | small-size components on sleeve | P/C Fog Initial | moving properties | sleeve filming | charging stability | Texture |
| Example 29 | 20 | 1.40 | ○ | ○ | ○ | ○ | ○ | ○ | ○ |
| Example 30 | 21 | 2.50 | ○ | ○ | ○ | ○ | ○ | ○ | ○ |
| Example 31 | 22 | 0.70 | ○ | ○ | ○ | ○ | ○ | ○ | ○ |
| Example 32 | 23 | 2.40 | ○ | ○ | ○ | ○ | ○ | ○ | ○ |
| Example 33 | 24 | 2.30 | ○ | ○ | ○ | ○ | ○ | ○ | ○ |
| Example 34 | 25 | 0.71 | ○ | ○ | ○ | ○ | ○ | ○ | ○ |
| Example 35 | 26 | 0.71 | ○ | ○ | ○ | ○ | ○ | ○ | ○ |
| Example 36 | 27 | 1.48 | ○ | ○ | ○ | ○ | ○ | ○ | ○ |
| Example 37 | 28 | 1.40 | ○ | ○ | ○ | ◎ | ○ | ○ | ○ |
| Example 38 | 20 | 1.40 | ○ | ○ | ○ | ○ | ○ | ○ | ○ |
| Example 39 | 28 | 1.40 | ○ | ○ | ○ | ◎ | ○ | ○ | ○ |
| Comparative Example 17 | 29 | 1.40 | ○ | × | ○ | × | × | × | × |
| Comparative Example 18 | 30 | 1.40 | ○ | × | ○ | × | × | × | × |
| Comparative Example 19 | 31 | 1.60 | ○ | × | ○ | × | × | × | × |
| Comparative Example 20 | 32 | 1.40 | ○ | × | ○ | × | × | × | × |
| Comparative Example 21 | 23 | 0.50 | × | × | × | × | × | × | × |
| Comparative Example 22 | 24 | 3.50 | × | × | ○ | × | × | × | × |

Evaluation methods and criterion of evaluation for the transferring properties, the amount of small-particle components on the sleeve, initial fog on P/C, moving properties, sleeve filming, charging stability and texture shown in Table 7 are explained as follows:

(Transferring properties)

With respect to excessive transfer, evaluation was made in the same manner as Example 1.

(Amount of small-particle components on the sleeve)

Evaluation was made in the same manner as Example 1.

(Initial Fog on P/C)

With respect to fog, tests were carried out by taking resistance against environment properties into consideration.

Environmental conditions

H/H environment: 35° C., 85% RH,

L/L environment: 10° C., 15% RH.

After 10 to 20 copies of B/W 30% image were made, one sheet was fed in the white developing mode and the copying process was suspended in the middle of the process. Then, the imaging cartridge was taken out of the copying machine (modified Di33) and fogs on the photosensitive member were observed.

Criterion of evaluation

○: No fog observed;

Δ: Fog slightly observed; however, no problem arose in practical use;

×: Fog observed.

(Moving properties)

Evaluation was made in the same manner as Example 14.

(Sleeve filming)

Sleeve filming is a surface layer of toner particle components formed on the surface of the sleeve due to fused and adhered toner particles, etc.

After 30,000 copies of B/W 30% image were mace, the surface of the sleeve was visually observed, and ranked as follows:

Criterion of evaluation

○: No filming observed;

Δ: Filming slightly observed; however, no problem arose in practical use;

×: Filming observed remarkably.

(Charging stability)

An image having a B/W ratio of 30% was copied, and the quantities of charge were measured at the initial stage and the stage after 30,000 copies was made (NN environment), and evaluation was made based on the difference between the two stages.

Criterion of evaluation

○: An absolute value of the difference in the quantities of charge between the initial copying stage and the stage after 30,000 copies was not more than 5 μC/g.

×: The value was greater than 5 μC/g.

(Texture of copied images)

Evaluation was made in the same manner as example 14.

What is claimed is:

1. A mono-component developing method, comprising the steps of:

supplying a mono-component developing agent containing a non-magnetic toner onto a developer-supporting member that is aligned face to face with an image-supporting member;

regulating the developing agent on the developer-supporting member by a regulating member installed in contact with the developer-supporting member; and developing an electrostatic latent image formed on the image-supporting member by the non-magnetic toner, wherein the non-magnetic toner comprises non-magnetic toner particles containing at least a binder resin and a colorant, said toner having a weight-average particle size ($d_{50}$) in the range of 4 to 10 μm, an average degree of roundness of not less than 0.960, a standard deviation of degree of roundness of not more than 0.040 and a value of $D/d_{50}$ of not less than 0.40 (in which $D=6/(\rho \cdot S)$, ρis a true density ($g/cm^3$) of toner, and S is a BET specific surface area ($m^2/g$) of toner), and a ratio $d_5l/Ra$ of the toner weight-average particle size ($d_{50}$) to the surface roughness (Ra) of the developer-supporting member is in the range of 0.6 to 3.0.

2. The method of claim 1, wherein said toner has an average degree of roundness of not less than 0.965 and a standard deviation of degree of roundness of not more than 0.035.

3. The method of claim 1, wherein said $D/d_{50}$ is in the range of 0.40 to 0.80.

4. The method of claim 1, wherein said $d_{50}/Ra$ is in the range of 0.7 to 2.5.

5. The method of claim 1, wherein said image-supporting member and said developer-supporting member is aligned face to face with each other in a contacted state.

6. The method of claim 1, wherein said image-supporting member and said developer-supporting member is aligned face to face with each other with a predetermined distance.

7. The method of claim 6, wherein the developing step is carried out under a vibration electric field.

8. The method of claim 7, wherein a ratio Vpp/Ds of a peak-to-peak value Vpp of said vibration electric field to a distance Ds between the image-supporting member and the developer-supporting member is set in the range of 4 to 9 kV/mm.

9. The method of claim 1, wherein inorganic fine particles are fixed on the surface of the toner particles.

10. The method of claim 9, said inorganic fine particles have a BET specific surface area in the range of 100 to 350 $m^2/g$.

11. The method of claim 9, said inorganic fine particles have a BET specific surface area in the range of 10 to 100 $m^2/g$.

12. The method of claim 9, wherein said inorganic fine particles comprise first inorganic fine particles having a BET specific surface area in the range of 100 to 350 $m^2/g$ and second inorganic fine particles having a BET specific surface area in the range of 10 to 100 $m^2/g$, the BET specific surface area of the first inorganic fine particles being greater than the BET specific surface area of the second inorganic fine particles by not less than 30 $m^2/g$.

13. The method of claim 9, wherein said toner contains a post-treating agent, the post-treating agent being externally admixed with the toner particles.

14. The method of claim 13, wherein said post-treating agent has a BET specific surface area in the range of 100 to 350 $m^2/g$.

15. The method of claim 13, wherein said post-treating agent has a BET specific surface area in the range of 1 to 100 $m^2/g$.

16. The method of claim 13, wherein said post-treating agent comprises a first post-treating agent having a BET specific surface area in the range of 100 to 350 $m^2/g$ and a second post-treating agent having a BET specific surface area in the range of 1 to 100 $m^2/g$, the BET specific surface area of the first post-treating agent being greater than the BET specific surface area of the second post-treating agent by not less than 30 $m^2/g$.

17. The method of claim 1, wherein said binder resin has a glass transition point of 50 to 75° C., a softening point of 80 to 120° C., a number-average molecular weight of 2,000 to 30,000 and a ratio of weight-average molecular weight/number-average molecular weight of 2 to 20.

18. The method of claim 1, wherein said binder resin comprises a first resin having a glass transition point of 50 to 75° C. and a softening point of 80 to 125° C. and a second resin having a glass transition point of 50 to 75° C. and a softening point of 125 to 160° C., the softening point of the second resin being higher than the softening point of the first resin by not less than 10° C.

19. A mono-component developing method, comprising the steps of:

supplying a mono-component developing agent containing a magnetic toner onto a developer-supporting member that is aligned face to face with an image-supporting member;

regulating the developer on the developer-supporting member by a regulating member installed in contact with the developer-supporting member; and developing an electrostatic latent image formed on the image-supporting member by the magnetic toner, in which the magnetic toner comprises magnetic toner particles containing at least a binder resin, a colorant and magnetic particles, said toner having a weight-average particle size ($d_{50}$) in the range of 4 to 10 μm, an average degree of roundness of not less than 0.950, a standard deviation of degree of roundness of not more than 0.040 and a value of $D/d_{50}$ of not less than 0.20 (in which $D=6/(\rho \cdot S)$, ρ is a true density ($g/cm^3$) of toner, and S is a BET specific surface area ($m^2/g$) of toner), and the ratio $d_5O/Ra$ of the toner weight-average particle size ($d_{50}$) to the surface roughness (Ra) of the developer-supporting member is in the range of 0.6 to 3.0.

20. The method of claim 19, wherein said magnetic toner has an average degree of roundness of not less than 0.955 and a standard deviation of degree of roundness of not more than 0.035.

21. The method of claim 19, wherein said $D/d_{50}$ is in the range of 0.20 to 0.55.

22. The method of claim 19, wherein said $d_{50}/Ra$ is in the range of 0.7 to 2.5.

23. The method of claim 19, wherein said image-supporting member and said developer-supporting member is aligned face to face with each other in a contacted state.

24. The method of claim 19, wherein said image-supporting member and said developer-supporting member is aligned face to face with each other with a predetermined distance.

25. The method of claim 24, wherein the developing step is carried out under a vibration electric field.

26. The method of claim 25, wherein a ratio Vpp/Ds of a peak-to-peak value Vpp of said vibration electric field to a distance Ds between the image-supporting member and the developer-supporting member is set in the range of 4 to 9 kV/mm.

27. The method of claim 19, wherein inorganic fine particles are fixed on the surface of the toner particles.

28. The method of claim 27, said inorganic fine particles have a BET specific surface area in the range of 100 to 350 $m^2/g$.

29. The method of claim 27, said inorganic fine particles have a BET specific surface area in the range of 10 to 100 $m^2/g$.

30. The method of claim 27, wherein said inorganic fine particles comprise first inorganic fine particles having a BET specific surface area in the range of 100 to 350 $m^2/g$ and second inorganic fine particles having a BET specific surface area in the range of 10 to 100 $m^2/g$, the BET specific surface area of the first inorganic fine particles being greater than the BET specific surface area of the second inorganic fine particles by not less than 30 $m^2/g$.

31. The method of claim 27, wherein said toner contains a post-treating agent, the post-treating agent being externally admixed with the toner particles.

32. The method of claim 31, wherein said post-treating agent has a BET specific surface area in the range of 100 to 350 $m^2/g$.

33. The method of claim 31, wherein said post-treating agent has a BET specific surface area in the range of 1 to 100 $m^2/g$.

34. The method of claim 31, wherein said post-treating agent comprises a first post-treating agent having a BET specific surface area in the range of 100 to 350 $m^2/g$ and a second post-treating agent having a BET specific surface area in the range of 1 to 100 $m^2/g$, the BET specific surface area of the first post-treating agent being greater than the BET specific surface area of the second post-treating agent by not less than 30 $m^2/g$.

35. The method of claim 19, wherein said binder resin comprises a first resin having a glass transition point of 50 to 75° C. and a softening point of 80 to 125° C. and c second resin having a glass transition point of 50 to 75° C. and a softening point of 125 to 160° C., the softening point of the second resin being higher than the softening point of the first resin by not less than 10° C.

* * * * *